US012492347B2

(12) United States Patent
Zhang et al.

(10) Patent No.: US 12,492,347 B2
(45) Date of Patent: Dec. 9, 2025

(54) PROCESS OF UPGRADING A PYROLYSIS OIL AND UPGRADING SOLUTION USED THEREIN

(71) Applicant: REFINITI LIMITED, Oxfordshire (GB)

(72) Inventors: Zhaoxi Zhang, Kidlington (GB); Benjamin Paul Williams, Kidlington (GB)

(73) Assignee: REFINITI LIMITED, Oxfordshire (GB)

( * ) Notice: Subject to any disclaimer, the term of this patent is extended or adjusted under 35 U.S.C. 154(b) by 34 days.

(21) Appl. No.: 18/479,896

(22) Filed: Oct. 3, 2023

(65) Prior Publication Data

US 2024/0093099 A1 Mar. 21, 2024

Related U.S. Application Data

(63) Continuation of application No. 17/436,723, filed as application No. PCT/GB2020/050539 on Mar. 6, 2020, now Pat. No. 11,959,026.

(30) Foreign Application Priority Data

Mar. 7, 2019 (GB) ..... 1903079

(51) Int. Cl.
*C10G 21/20* (2006.01)
*C10G 1/00* (2006.01)
(Continued)

(52) U.S. Cl.
CPC ..... *C10G 21/20* (2013.01); *C10G 1/002* (2013.01); *C10G 1/10* (2013.01); *C10G 21/14* (2013.01);
(Continued)

(58) Field of Classification Search
CPC . C10G 1/002; C10G 1/10; C10G 3/00; C10G 21/14; C10G 21/16; C10G 21/20;
(Continued)

(56) References Cited

U.S. PATENT DOCUMENTS

2012/0217149 A1 8/2012 Ma
2013/0048901 A1* 2/2013 Gadkaree ..... H01G 9/035 252/62.2
(Continued)

FOREIGN PATENT DOCUMENTS

CN 101531922 B 5/2012
CN 105969422 A 9/2016
(Continued)

OTHER PUBLICATIONS

Eom, Y., et al., 2014, Polymer, 55, 2570-2577. < http://dx.doi.org/10.1016/j.polymer.2014.03.047> (Year: 2014).*
(Continued)

*Primary Examiner* — Brian A McCaig
(74) *Attorney, Agent, or Firm* — Meunier Carlin & Curfman LLC

(57) ABSTRACT

A process for upgrading a pyrolysis oil comprising treating the pyrolysis oil with an upgrading solution to provide a mixture comprising an extract phase and a raffinate phase, wherein the upgrading solution comprises a polar organic solvent, and wherein the pyrolysis oil is a derived from the pyrolysis of plastic or rubber, or a combination thereof, and an upgraded pyrolysis oil prepared by said process.

14 Claims, 6 Drawing Sheets

(51) Int. Cl.

| | |
|---|---|
| ***C10G 1/10*** | (2006.01) |
| ***C10G 21/14*** | (2006.01) |
| ***C10G 21/16*** | (2006.01) |
| ***C10G 21/22*** | (2006.01) |

(52) U.S. Cl.
CPC ..... *C10G 21/16* (2013.01); *C10G 21/22* (2013.01); *C10G 2300/1003* (2013.01); *C10G 2300/44* (2013.01); *C10G 2300/805* (2013.01)

(58) Field of Classification Search
CPC ..... C10G 21/22; C10G 2300/1003; C10G 2300/44; C10G 2300/805; F23G 5/027; F23G 7/12; F23G 2209/28
See application file for complete search history.

(56) References Cited

U.S. PATENT DOCUMENTS

| | | | |
|---|---|---|---|
| 2014/0352204 | A1 | 12/2014 | Belanger |
| 2015/0337087 | A1 | 11/2015 | Zhou et al. |
| 2018/0312768 | A1 | 11/2018 | Fan et al. |
| 2018/0355256 | A1 | 12/2018 | Dooley |

FOREIGN PATENT DOCUMENTS

| | | | |
|---|---|---|---|
| CN | 105602613 | B | 10/2017 |
| GB | 2535797 | A | 8/2016 |
| GB | 2550930 | A | 6/2017 |
| WO | 01/94498 | A1 | 12/2001 |
| WO | 2017088015 | A1 | 6/2017 |
| WO | 2018104443 | A1 | 6/2018 |
| WO | 2020212315 | A1 | 10/2020 |

OTHER PUBLICATIONS

Di Mino, C., et al., 2023, Journal of Physical Chemistry B, 127, 1357-1366. <https://doi.org/10.1021/acs.jpcb.2c07155> (Year: 2023).*
SAGE Solvent Guide (Year: 2001).*
Burke, J., 1984, Solubility Parameters: Theory and Application, American Institute of Conservation, The Book and Paper Group, vol. 3. (Year: 1984).*
Stenutz, R. <https://www.stenutz.eu/chem/solv6.php?name=propylene%20carbonate> (Year: 2025).*
International Search Report and Written Opinion issued in PCT/GB2020/050539, dated Jul. 13, 2020, 13 pages.
UK Search Report issued in GB1903079.0, dated Aug. 28, 2019, 4 pages.
International Preliminary Report on Patentability in connection to PCT/GB2020/050539, dated Mar. 6, 2020.
Notice of Allowance issued for Parent U.S. Appl. No. 17/436,723, dated Oct. 24, 2023.
Notice of Allowance issued for Parent U.S. Appl. No. 17/436,723, dated Jul. 3, 2023.
Office Action issued for Parent U.S. Appl. No. 17/436,723, dated Dec. 30, 2022.

* cited by examiner

PROCESS OF UPGRADING A PYROLYSIS OIL AND UPGRADING SOLUTION USED THEREIN

INTRODUCTION

Described herein is a process for upgrading the quality of pyrolysis oil derived from plastic, rubber or a combination thereof. The low cost and efficient process utilises sustainable resources to produce stable pyrolysis oil which may be utilised either as a transportation fuel, for blending with fuels and/or as a chemical feedstock.

BACKGROUND OF THE INVENTION

The total amount of plastics manufactured from 1950 through to 2015 is about 8300 Mt. Half of this was produced in just the past 13 years.[2] If current production and waste management trends continue, roughly 12,000 Mt of plastic waste will be in landfills or in the natural environment by 2050.[2] Between 1950 and 2015, cumulative waste generation of primary and secondary (recycled) plastic waste amounted to 6300 Mt, of this approximately 800 Mt (12%) of plastics have been incinerated and 600 Mt (9%) have been recycled, only 10% of which have been recycled more than once. Around 4900 Mt-60% of all plastics ever produced—were discarded and are accumulating in landfills or in the natural environment (FIG. 1)[2].

Plastic items that enter the waste stream are made in a wide range of formats and from a variety of polymer types. The bulk of this material is plastic film from commercial and domestic packaging sources, and arises from municipal material recovery facilities (MRFs), with the remainder from composting and anaerobic digestion facilities.[1]

Processes for conversion of waste plastics and other solid hydrocarbon materials to oil are known. Gasification and pyrolysis techniques for coal were commercialised in Germany during the Second World War and developed further in South Africa during the Apartheid years. Plastic depolymerisation techniques were developed actively during the 1980s and 1990s, but none was adopted commercially as mechanical recycling methods developed, rapidly. Over the past 10 years there has been an increase in the amount of research into the conversion of plastic into oil, as oil prices have increased and waste collection and sorting methods have improved. There are now several processes operating close to commercial viability in different parts of the world.

The processes that have the most technical and commercial potential fall into three categories:[1]

- Fast gas phase pyrolysis to make synthetic crude oil mixtures;
- Liquid-phase catalytic depolymerisation to make mixed distillates; and
- Gasification, followed by chemical or biological synthesis; to make high-quality fuels.

Gasification processes with downstream synthesis of high-quality fuels are much more capital intensive, requiring larger economies of scale than the pyrolysis and catalytic depolymerisation. These processes have lower product yields (30-60% of the feedstock, is recovered as a liquid fuel) but recover energy as electricity from the high-pressure, high-temperature processes.[1]

In comparison, pyrolysis and catalytic depolymerisation processes have a relatively low capital cost and a relatively high yield (60-70% of the feedstock is converted to a liquid). However, the quality of these oil products is low and further processing is required to give a fuel product. Despite this, the high yield improves the environmental and economic viability of these processes.[1]

Low quality of the plastic pyrolysis oil is mainly due to solid residues, high olefin content and high heteroatom content.

The solid residue content is likely due to the inorganic content (e.g. dirt, soil, sand, $SiO_2$ etc.) and/or coke/char content and/or unconverted plastics (e.g. HDPE, PP etc.).[3] Accordingly, the pyrolysis oil cannot meet the standard required of transportation fuels as the solid residue would be very harmful to an internal combustion engine (ICE)'s cylinders and will easily block the oil distribution line and oil filter; thus leading to inefficient burning of the fuel.

Therefore, plastic pyrolysis oil upgrading processes tend to require removal of solid residue by filtration or centrifugation. However, due to the large quantity of the feed stream that needs to be processed, these upgrading processes significantly increase the capital and operation cost in a waste plastic-to-fuel process.

A high concentration of olefin exists in all kinds of plastic pyrolysis oil. As shown in the table below, the yield of the total-olefin fraction from polyethylene (PE) is 42.6%, from polypropylene (PP) is 44.7% and from municipal plastic waste is 37.3%.[4]

| | Plastic Type | | |
|---|---|---|---|
| Fraction | PE | PP | Municipal Plastic Waste |
| Total-paraffin | 35.6 | 30.4 | 32.5 |
| Total-olefin | 42.6 | 44.7 | 37.3 |
| Naphthene | 19.6 | 21.5 | 20.7 |
| Aromatics | 5.8 | 1.4 | 7.9 |
| Others | 1.4 | 2.0 | 1.6 |

The high olefin content in the plastic pyrolysis oil leads to instability. In particular, during storage, olefins react with atmospheric oxygen and with other components. Due to the ensuing polymerization reactions leading to the formation of gums, detrimental changes in plastic pyrolysis oil's physical-chemical characteristics occur.[5] These polymeric materials lead to deposition in oil filters and distribution lines of engines. Thus, plastic pyrolysis oil must go through an upgrading treatment, such as hydrogenation, to reduce the olefin level.[5]

As a consequence, the capital cost and operation cost will be heavily increased. A simpler route is to blend the plastic pyrolysis oil into commercial gasoline/diesel to dilute the unstable olefin content.[6,7] However, this will certainly decease the stability of the original fuels due to the increased olefin content even if the mixture can fulfil the required fuel standard, and may lead to higher emissions.[7]

Plastics, such as poly vinyl chloride (PVC) and acrylonitrile-butadiene-styrene (ABS), used as flame retardants contain heteroatoms such as chlorine, nitrogen, and bromine that remain as organic compounds in plastic pyrolysis oils during thermal degradation and also produce acids or toxic gases such as HCl, HBr, HCN, $NH_3$ or polyhalogenated dibenzodioxins and dibenzofurans,[8-10] whose presence in pyrolysis oils is not desired.

Thermal degradation of ABS gives oils that besides high amounts of benzene derivatives also contain organic nitrogen as aliphatic and aromatic nitriles or nitrogen containing heterocyclic compounds.[8,11] Brominated flame retardants in ABS also give organic bromine compounds in oil, of which bromophenol, bromobenzene and bromomethane are notable.[8,12]

On the other hand, there have been many reports on the pyrolysis of PVC alone[13,14] or mixed with other polymers.[8,15] Hydrochloric acid and organic chlorine-containing compounds are formed during the initial stages of the process.[8,16,17]

Therefore, the amounts of these undesired contents in plastic pyrolysis oil have to be decreased as much as possible.

Removal of the halogen and undesired contents in the plastics by catalytic conversion has been reported. Bhaskar et al.[12] reported the development of calcium-, iron-, and potassium-based carbon composites for capture of hydrogen chloride gas. Calcium- and iron-based composites were found to be effective catalysts in debromination of pyrolysis oils from polymers mixed with high-impact polystyrene or brominated ABS.[18-20] Iron oxides and iron carbon composites decrease the amount of nitrogen in ABS pyrolysis oil and convert the aromatic nitriles into light aliphatic nitriles and gaseous ammonia and hydrogen cyanide.[21]

Brebu et al, reported the decomposition of polymer mixtures containing PE, PP, PS, ABS-Br and PVC and the effect of iron- and calcium-based catalysts on the removal of bromine, chlorine and nitrogen from plastic pyrolysis oils.[8] In their research, iron- and calcium-based catalysts were used in vapour phase contact (VPC) mode.[8] This means the catalysts are in contact and react with the volatile products from primary degradation of plastics.

Brebu et al, observed that the oil product from thermal decomposition of a complex polymer mixture contains significant amounts of bromine (1900 ppm), chlorine (5000 ppm) and nitrogen (1200 ppm) coming from decomposition of brominated ABS and of PVC.[8] The removal performance of various catalysts for bromine, chloride and nitrogen from Brebu et al.'s research are summarised in the table below.

| | Bromine (ppm) | Chlorine (ppm) | Nitrogen (ppm) |
|---|---|---|---|
| Thermal | 1924 | 4972 | 1214 |
| Catalyst | | | |
| FeO(OH) | 104 | 3370 | 840 |
| $Fe_3O_4$ based | 170 | 1014 | 981 |
| $CaCO_3$ based | 418 | 113 | 1370 |
| $CaCO_3$ | 1161 | 335 | 1078 |

Iron oxy-hydroxide gives the lowest amount of organic bromine (104 ppm) and nitrogen (840 ppm) in plastic pyrolysis oil, and the $CaCO_3$ based catalyst gives the lowest amount of organic chlorine (113 ppm) in plastic pyrolysis oil. The authors concluded that pure iron oxy-hydroxide and iron (II,III) oxide based catalyst were found to be effective in removing with more than 90 wt % the organic bromine from degradation oils while calcium carbonate based catalyst and pure calcium carbonate give best results in chlorine removal.[8]

Although catalytic conversion can remove the majority of the heteroatoms, there is still some heteroatom content (<100 ppm) left in the output fuel, and this makes it unsuitable for application in an internal combustion engine.

There is a need in the art for alternative approaches for the upgrading, of pyrolysis oils, particularly pyrolysis oils derived from plastic, rubber or a combination thereof. Suitably, new approaches to upgrading will provide higher quality pyrolysis oil which have at least one or more advantages selected from lower olefin content, lower solid residue content and lower heteroatom content. The upgraded pyrolysis oil products may be utilised as transportation fuel, for blending with fuels and/or as a chemical feedstock.

SUMMARY OF THE INVENTION

In a first aspect, the present invention relates to a process for upgrading a pyrolysis oil comprising treating the pyrolysis oil with an upgrading solution to provide a mixture comprising an extract phase and a raffinate phase, wherein the upgrading solution comprises a polar organic solvent, and wherein the pyrolysis oil is a derived from the pyrolysis of plastic or rubber, or a combination thereof.

In a second aspect, the present invention relates to a process for producing an upgraded pyrolysis oil product comprising:

(i) treating a pyrolysis oil with an upgrading solution, wherein the upgrading solution comprises an polar organic solvent;

(ii) mixing the pyrolysis oil and the upgrading solution and then allowing the mixture to form two phases consisting of a raffinate phase and an extract phase, and (iii) separating the raffinate phase from the extract phase to yield an upgraded pyrolysis oil product;

wherein the pyrolysis oil is a derived from the pyrolysis of plastic or rubber, or a combination thereof.

In a third aspect, the present invention relates to the use of an upgrading solution for decreasing the olefin content of a pyrolysis oil, wherein the upgrading solution comprises a polar organic solvent, and wherein the pyrolysis oil is a derived from the pyrolysis of plastic or rubber, or a combination thereof.

In a fourth aspect, the present invention relates to the use of an upgrading solution for decreasing the solid residue content of a pyrolysis oil, wherein the upgrading solution comprises a polar organic solvent; and wherein the pyrolysis oil is a derived from the pyrolysis of plastic or rubber, or a combination thereof.

In a fifth aspect, the present invention relates to the use of an upgrading solution for increasing the stability of a pyrolysis oil, wherein upgrading solution comprises wherein the upgrading solution comprises a polar organic solvent; and wherein the pyrolysis oil is a derived from the pyrolysis of plastic or rubber, or a combination thereof.

In a sixth aspect, the present invention relates to an upgraded pyrolysis oil obtainable by a process according to the first or second aspects of the invention.

Preferred, suitable, and optional features of any one particular aspect of the present invention are also preferred, suitable, and optional features of any other aspect.

DETAILED DESCRIPTION OF THE INVENTION

Definitions

Figure 1:
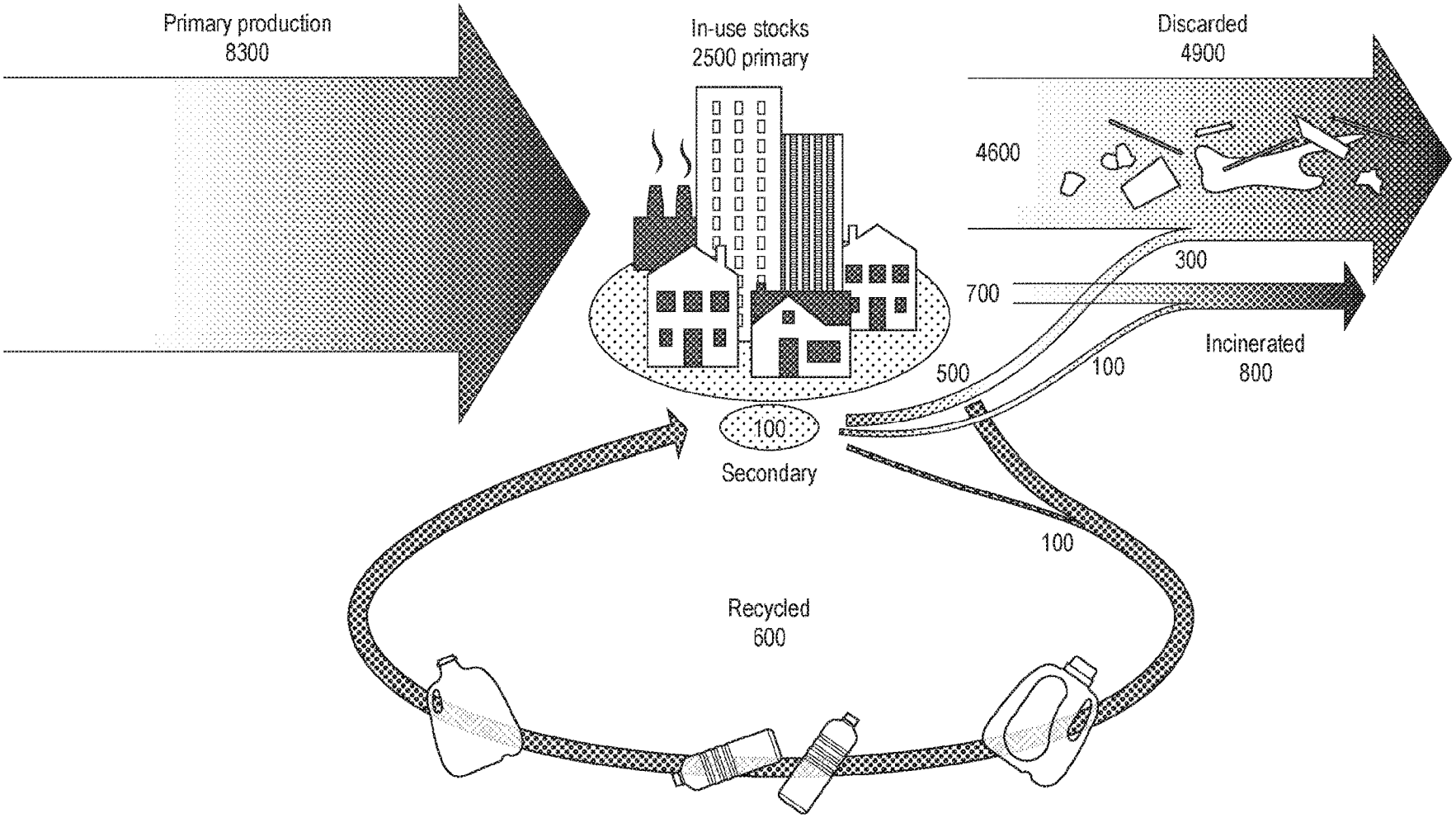
FIG. 1 provides details of global plastic use and the fate of plastics after use in millions of metric tons.

As used herein, in each aspect of the invention, the term "upgrading" and "upgraded" used in relation to a pyrolysis oil refers to removing or reducing the concentration of one or more unwanted substances in the pyrolysis oil, and/or imparting or enriching the pyrolysis oil with one or more desirable substances.

As used herein, the term "solid residue" refers to solid material which remains after the pyrolysis oil has been heated to high temperature (i.e. above about 400° C.) and cooled down to standard ambient temperature and pressure (SATP) (i.e. at a temperature of about 298.15 K (25° C.) and a pressure of about 100,000 Pa (1 bar, 14.5 psi, 0.9869 atm)).

As used herein the term "hydrocarbon" refers to organic compounds consisting of carbon and hydrogen.

For the avoidance of doubt, hydrocarbons include straight-chained and branched, saturated and unsaturated aliphatic hydrocarbon compounds, including alkanes, alkenes, and alkynes, as well as saturated and unsaturated cyclic aliphatic hydrocarbon compounds, including cycloalkanes, cycloalkenes and cycloalkynes, as well as hydrocarbon polymers, for instance polyolefins.

Hydrocarbons also include aromatic hydrocarbons, i.e. hydrocarbons comprising one or more aromatic rings. The aromatic rings may be monocyclic or polycyclic.

Aliphatic hydrocarbons which are substituted with one or more aromatic hydrocarbons, and aromatic hydrocarbons which are substituted with one or more aliphatic hydrocarbons, are also of course encompassed by the term "hydrocarbon" (such compounds consisting only of carbon and hydrogen) as are straight-chained or branched aliphatic hydrocarbons that are substituted with one or more cyclic aliphatic hydrocarbons, and cyclic aliphatic hydrocarbons that are substituted with one or more straight-chained or branched aliphatic hydrocarbons.

A "$C_{n-m}$ hydrocarbon" or "$C_n$-$C_m$ hydrocarbon" or "Cn-Cm hydrocarbon", where n and m are integers, is a hydrocarbon, as defined above, having from n to m carbon atoms. For instance, a $C_{1-150}$ hydrocarbon is a hydrocarbon as defined above which has from 1 to 150 carbon atoms, and a $C_{5-60}$ hydrocarbon is a hydrocarbon as defined above which has from 5 to 60 carbon atoms.

The term "alkane", as used herein, refers to a linear or branched chain saturated hydrocarbon compound. Examples of alkanes, are for instance, butane, pentane, hexane, heptane, octane, nonane, decane, undecane, dodecane, tridecane, tetradecane and hexadecane. Alkanes such as dimethylbutane may be one or more of the possible isomers of this compound. Thus, dimethylbutane includes 2,3-dimethybutane and 2,2-dimethylbutane. This also applies for all hydrocarbon compounds referred to herein including cycloalkane, alkene, cycloalkene.

The term "cycloalkane", as used herein, refers to a saturated cyclic aliphatic hydrocarbon compound. Examples of cycloalkanes include cyclopropane, cyclobutane, cyclopentane, cyclohexane, methylcydopentane, cycloheptane, methylcyclohexane, dimethylcyclopentane and cyclooctane. Examples of a $C_{5-8}$ cycloalkane include cyclopentane, cyclohexane, methylcyclopentane, cycloheptane, methylcyclohexane, dimethylcyclopentane and cyclooctane. The terms "cycloalkane" and "naphthene" may be used interchangeably.

The term "alkene", as used herein, refers to a linear or branched chain hydrocarbon compound comprising one or more double bonds. Examples of alkenes are butene, pentene, hexene, heptene, octene, nonene, decene, undecene, dodecene, tridecene and tetradecene. Alkenes typically comprise one or two double bonds. The terms "alkene" and "olefin" may be used interchangeably. The one or more double bonds may be at any position in the hydrocarbon chain. The alkenes may be cis- or trans-alkenes (or as defined using E- and Z-nomenclature). An alkene comprising a terminal double bond may be referred to as an "alk-1-ene" (e.g. hex-1-ene), a "terminal alkene" (or a "terminal olefin"), or an "alpha-alkene" (or an "alpha-olefin"). The term "alkene", as used herein also often includes cycloalkenes.

The term "cycloalkene", as used herein, refers to partially unsaturated cyclic hydrocarbon compound. Examples of a cycloalkene includes cyclobutene, cyclopentene, cyclohexene, cyclohexa-1,3-diene, methylcyclopentene, cycloheptene methylcyclohexene, dimethylcyclopentene and cyclooctene. A cycloalkene may comprise one or two double bonds.

The term "aromatic hydrocarbon" or "aromatic hydrocarbon compound", as used herein, refers to a hydrocarbon compound comprising one or more aromatic rings. The aromatic rings may be monocyclic or polycyclic. Typically, an aromatic compound comprises a benzene ring. An aromatic compound may for instance be a $C_{6-14}$ aromatic compound, a $C_{6-12}$ aromatic compound or a $C_{6-10}$ aromatic compound. Examples of $C_{6-14}$ aromatic compounds are benzene, toluene, xylene, ethylbenzene, methylethylbenzene, diethylbenzene, naphthalene, methylnaphthalene, ethylnaphthalene and anthracene.

As used herein the term "plastic" refers to a solid material which comprises one or more thermoplastic or thermosetting polymers. Suitably, the plastic (essentially) consists of one or more thermoplastic or thermosetting polymers. Suitably the plastic (essentially) consists of one or more thermoplastic polymers. Suitably, the plastic is waste plastic which may be a mixture of various plastics. Plastics may be referred to by the name of the polymer of which they consist. Examples of common plastics are polyethylene, polypropylene and polystyrene.

As used herein the term "thermoplastic polymer" refers to a polymer which becomes pliable or mouldable above a certain temperature and solidifies upon cooling, but can be remelted on heating. Typically thermoplastic polymers have a melting temperature from about 60° C. to about 300° C., from about 80° C. to about 250° C., or from about 100° C. to about 250° C.

Suitably, the thermoplastic polymer is one which is commonly comprised in commercial plastic products. Suitable thermoplastic polymers generally include polyolefins, polyesters, polyamides, copolymers thereof, and combinations thereof. Examples of thermoplastic polymers include polyethylene (PE), polypropylene (PP), polystyrene (PS), polyvinylchloride (PVC), polyamideimide, polymethylmethacrylate (PMMA), polytetrafluoroethylene, polyethylene terephthalate (PET), natural rubber (NR), and polycarbonate (PC), polyvinylidene chloride (PVDC), acrylonitrile butadiene styrene (ABS), polyurethanes (PU).

As used herein the term "thermosetting polymer" refers to a polymer which is irreversibly cured and cannot be reworked upon reheating. Examples of thermosetting polymers are polyurethane and polyoxybenzylmethylenglycol-anhydride (Bakelite™).

As used herein the term "specific gravity (20/4)" refers to the true density of a sample at 20° C. divided by water density at 4° C.

As used herein the term "fluid" refers to a material which is a liquid or gas at standard ambient temperature and pressure (SATP), (i.e. at a temperature of about 298.15 K (25° C.) and a pressure of about 100,000 Pa (1 bar, 14.5 psi, 0.9869 atm).

As used herein the term "liquid" suitably refers to a liquid at standard ambient temperature and pressure (SATP) (i.e. at a temperature of about 298.15 K (25° C.) and a pressure of about 100,000 Pa (1 bar, 14.5 psi, 0.9869 atm)).

As used, herein the term "sulphur removal catalyst" refers to a catalyst commonly employed in hydrodesulfurization reactions. Sulphur removal catalysts may also be referred to as HDS catalysts. Examples of sulphur removal catalysts are well known to the skilled person. For example, a sulphur removal catalyst is typically comprises a transition metal. For instance, sulphur removal catalyst typically comprises a transition metal capable of forming bonds to sulphur or oxygen, for example, Ni, Mo, Co, Cu, Zn, W, Fe, W, Pd, Pt, Rh, Ru.

Extraction Process

In one aspect, the present invention relates to a process for upgrading a pyrolysis oil comprising treating the pyrolysis oil with an upgrading solution to provide a mixture comprising an extract phase and a raffinate phase, wherein the upgrading solution comprises a polar organic solvent, and wherein the pyrolysis oil is a derived from the pyrolysis of plastic or rubber, or a combination thereof.

In another aspect, the present invention relates to a process for producing an upgraded pyrolysis oil product comprising:

(i) treating a pyrolysis oil with an upgrading solution, wherein the upgrading solution comprises an polar organic solvent;

(ii) mixing the pyrolysis oil and the upgrading solution and then allowing the mixture to form at least two phases comprising a raffinate phase and an extract phase, and (iii) separating the raffinate phase from the extract phase to yield an upgraded pyrolysis oil product;

wherein the pyrolysis oil is a derived from the pyrolysis of plastic or rubber, or a combination thereof.

In another aspect, the present invention relates to a process for producing an upgraded pyrolysis oil product comprising:

(i) treating a pyrolysis oil with an upgrading solution, wherein the upgrading solution comprises an polar organic solvent;

(ii) mixing the pyrolysis oil and the upgrading solution and then allowing the mixture to form two phases consisting of a raffinate phase and an extract phase, and (iii) separating the raffinate phase from the extract phase to yield an upgraded pyrolysis oil product;

wherein the pyrolysis oil is a derived from the pyrolysis of plastic or rubber, or a combination thereof.

In another aspect, the present invention relates to a process for producing an upgraded pyrolysis oil product comprising:

(i)(a) treating a pyrolysis oil with an upgrading solution, wherein the upgrading solution comprises an polar organic solvent;

(i)(b) optionally treating the product of (i)(a) with a hydrocarbon fluid;

(ii) mixing the pyrolysis oil and the upgrading solution obtained from (i)(a), or optionally (i)(b), and then allowing the mixture to form at least two phases comprising a raffinate phase and an extract phase, and (iii) separating the raffinate phase from the extract phase to yield an upgraded pyrolysis oil product;

wherein the pyrolysis oil is a derived from the pyrolysis of plastic or rubber, or a combination thereof.

In one embodiment, "upgrading" and "upgraded" used in relation to a pyrolysis oil refers to removing or reducing the concentration of one or more unwanted substances in the pyrolysis. In another embodiment, the term "upgrading" and "upgraded" used in relation to a pyrolysis refers to imparting or enriching the pyrolysis oil with one or more desirable substances. Typically, upgraded/upgrading is assessed relative to the pyrolysis to be upgraded, i.e. the starting pyrolysis oil prior to being subjected to the process of the invention.

In one embodiment, the unwanted substances to be removed or reduced are selected from one or more of solid residues (e.g. inorganic materials, coke, char) olefins and compounds containing heteroatoms, such as sulphur, nitrogen or halogens. In another embodiment, the unwanted substances consist of solid residue, olefins and sulphur compounds.

In another embodiment, the unwanted substances consist of compounds containing heteroatoms, suitably the compounds containing heteroatoms are selected from sulphur compounds, nitrogen compounds and halogen compounds, or combinations thereof.

In one embodiment, the sulphur compounds reduced/removed by the process of the invention comprise organic sulphur compounds (OSCs). In another embodiment, the sulphur compounds consist of organic sulphur compounds. In another embodiment, the sulphur compounds reduced/removed comprise compounds selected from thiols, thioethers, disulphides, thiophenes and benzothiophenes. In another embodiment, the sulphur compounds reduced/removed are selected from thiols, thioethers, disulphides, thiophenes and benzothiophenes.

In one embodiment, the halogen compounds are halogen compounds commonly found in plastic or rubber pyrolysis oils. These compounds include for instance halogenated acids (such as HCl and HBr) and halogenated aromatics, such a polyhalognated dibenzoditoxins an ddibenzofurans.

In one embodiment, the nitrogen compounds are molecules containing nitrogen which are commonly found in pyrolysis products. In one embodiment, the nitrogen compounds reduced/removed by the process of the invention comprise organic nitrogen compounds, such as ammonia and organic amines and imines.

In another embodiment, the unwanted substances consist of olefins, suitably alpha-olefins. In another embodiment, the olefins reduced/removed by the process of the invention are linear or branched $C_2$ to $C_{18}$ olefins. In another embodiment, the olefins reduced/removed are linear, branched or cyclic $C_4$ to $C_{14}$ olefins. In another embodiment, the olefins reduced/removed are linear, branched or cyclic $C_4$ to $C_{12}$ olefins. In another embodiment, the olefins reduced/removed are linear, branched or cyclic $C_4$ to $C_{10}$ olefins.

In one embodiment, desirable substances which may be enriched/imparted to the upgraded pyrolysis oil include oxygenates. Oxygenates are desirable in fuels such as gasoline, because they increase octane rating, and thus allow the reduction of cancer causing aromatic compounds. Hence, oxygenates in fuel assist with policy aims to reduce CO emissions and particulates in exhaust gases.

In another embodiment, the desirable substances enriched/imparted consist of oxygenates. As used herein the term "oxygenates" refers to hydrocarbons that contain one or more oxygen atoms. In one embodiment, the oxygenates enriched/imparted are selected from one or more of ethers, esters, ketones, carboxylic acids, aldehydes and alcohols. In another embodiment, the oxygenates are selected from one or more of ethers, esters, aldehydes, ketones and alcohols. In another embodiment, the oxygenates are selected from one or more of ethers, aldehydes, ketones and alcohols. In another embodiment, the oxygenates are selected from one or more of ethers, suitably alpha ethers.

Examples of oxygenates which may be enriched/imparted in/to the pyrolysis oil/raffinate phase include methyl tert-butyl ether (MTBE), ethyl tert-butyl ether (ETBE), tert-amyl methyl ether (TAME) and diisopropyl ether (DIPE).

The pyrolysis oil and the upgrading solution may be mixed by any means known in the art. For instance, the pyrolysis oil and the upgrading solution may be added to vessels, reactors or mixers commonly used in the art and the two components may be mixed. Mixing may comprise vigorous agitation of the two components by a mixing means. For instance, the two components may be mixed together by stirring or by shaking.

The mixing of the two components may occur more than once. For instance, after mixing the pyrolysis oil and the upgrading solution for the first time, the resulting two phases may be mixed again, possible numerous times. The steps of contacting and formation of two phases may be continuous. Thus, the two components may pass through a mixing means before entering a separating chamber in which the first and second phases are formed. The contacting of the two components may be performed using a propeller, counter-current flow means, an agitation means, a Scheibel® column, a KARR® column or a centrifugal extractor.

The pyrolysis oil may be repeatedly mixed multiple times with fresh batches of upgrading solution. For instance, the pyrolysis oil may be mixed with a first batch of an upgrading solution to provide a first raffinate phase and a first extract phase. Following separation of the raffinate phase from the extract phase the raffinate phase may be mixed with a second batch of the upgrading solution to provide a second raffinate phase and a second extract phase. This cycle may be repeated multiple times.

In one embodiment the cycle of mixing the pyrolysis oil and its raffinate with upgrading solution is repeated between 1 and 9 times. In another embodiment, the cycle is repeated between 1 and 4 times. In another embodiment, the cycle is repeated 1, 2, 3 or 4 times. In another embodiment, the cycle is repeated 4 times.

Typically, the pyrolysis oil and upgrading solution are mixed to the extent to allow effective extraction of the pyrolysis oil by the upgrading solution. In respect of two immiscible solutions, the skilled person would understood that typically these solutions are intimately mixed until an emulsion is formed which is subsequently allowed to separate into two phases.

In one embodiment, the mixing is carried out at ambient temperature and pressure. Typically, a temperature of between about 18 to 28° C., more typically between about 21 and 25° C., and a pressure of about 100 kPa. Accordingly, expense and other problems associated with high temperature or pressure conditions are avoided.

Alternatively, the mixing is carried out at a temperature between about 0° C. and about 70° C., suitably about 15° C. to about 50° C.

Typically, the mass ratio of pyrolysis oil to upgrading solution is from about 95:5 to about 10:90. In one embodiment, the mass ratio of pyrolysis oil to upgrading solution is about 95:5 to about 50:50, or suitably about 95:5 to about 60:40, or suitably about 95:5 to about 70:30 or suitably about 95:5 to about 80:20. In one embodiment, the mass ratio of pyrolysis oil to upgrading solution is about 90:10.

As used herein the term "raffinate phase" refers to the phase comprising/consisting essentially of/consisting of the upgraded pyrolysis oil.

In one embodiment, the raffinate phase/upgraded pyrolysis oil will have a reduced concentration of undesirable substances compared to the pyrolysis oil prior to mixing with the upgrading solution.

In one embodiment, the raffinate phase/upgraded pyrolysis oil will have a reduced concentration of one or more of sulphur compounds, olefins and solid residue compared to the pyrolysis oil prior to mixing with the upgrading solution.

In one embodiment, the concentration of sulphur compounds in the raffinate phase/upgraded pyrolysis oil is reduced by about 10% to about 80% (wt. %) relative to the concentration of sulphur compounds in the starting pyrolysis oil. In another embodiment, the concentration of sulphur compounds in the raffinate phase/upgraded pyrolysis oil is reduced by about 10% to about 70% (wt. %) relative to the concentration of sulphur compounds in the starting pyrolysis oil. In another embodiment, the concentration of sulphur compounds in the raffinate phase/upgraded pyrolysis oil is reduced by about 30% to about 80% (wt. %) relative to the concentration of sulphur compounds in the starting pyrolysis oil. In another embodiment, the concentration of sulphur compounds in the raffinate phase/upgraded pyrolysis oil is reduced by about 30% to about 70% (wt. %) relative to the concentration of sulphur compounds in the starting pyrolysis oil. In another embodiment, the concentration of sulphur compounds in the raffinate phase/upgraded pyrolysis oil is reduced by about 40% to about 60% (wt. %) relative to the concentration of sulphur compounds in the starting pyrolysis oil.

In one embodiment, the raffinate phase/upgraded pyrolysis oil will have a reduced concentration of olefins compared to the pyrolysis oil prior to mixing with the upgrading solution.

In one embodiment, the concentration of olefins in the raffinate phase/upgraded pyrolysis oil is reduced by about 10% to about 80% (wt. %) relative to the concentration of olefins in the starting pyrolysis oil. In another embodiment, the concentration of olefins in the raffinate phase/upgraded pyrolysis oil is reduced by about 10% to about 70% (wt. %) relative to the concentration of olefins in the starting pyrolysis oil. In another embodiment, the concentration of olefins in the raffinate phase/upgraded pyrolysis oil is reduced by about 30% to about 80% (wt. %) relative to the concentration of olefins in the starting pyrolysis oil. In another embodiment, the concentration of olefins in the raffinate phase/upgraded pyrolysis oil is reduced by about 30% to about 70% (wt. %) relative to the concentration of olefins in the starting pyrolysis oil. In another embodiment, the concentration of olefins in the raffinate phase/upgraded pyrolysis oil is reduced by about 40% to about 60% (wt. %) relative to the concentration of olefins in the starting pyrolysis oil.

In one embodiment, the raffinate phase/upgraded pyrolysis oil will have a reduced concentration of chloride compared to the pyrolysis oil prior to mixing with the upgrading solution.

In one embodiment, the concentration of chloride in the raffinate phase/upgraded pyrolysis oil is reduced by about 10% to about 80% (wt. %) relative to the concentration of chloride in the starting pyrolysis oil. In another embodiment, the concentration of chloride in the raffinate phase/upgraded pyrolysis oil is reduced by about 10% to about 70% (wt. %) relative to the concentration of chloride in the starting pyrolysis oil. In another embodiment, the concentration of chloride in the raffinate phase/upgraded pyrolysis oil is reduced by about 10% to about 60% (wt. %) relative to the concentration of chloride in the starting pyrolysis oil.

In another embodiment, the concentration of chloride in the raffinate phase/upgraded pyrolysis oil is reduced by about 30% to about 80% (wt. %) relative to the concentration of chloride in the starting pyrolysis oil. In another embodiment, the concentration of chloride in the raffinate phase/upgraded pyrolysis oil is reduced by about 30% to about 70% (wt. %) relative to the concentration of chloride in the starting pyrolysis oil. In another embodiment, the concentration of chloride in the raffinate phase/upgraded pyrolysis oil is reduced by about 30% to about 60% (wt. %) relative to the concentration of chloride in the starting pyrolysis oil.

In another embodiment, the concentration of chloride in the raffinate phase/upgraded pyrolysis oil is reduced by about 40% to about 60% (wt. %) relative to the concentration of chloride in the starting pyrolysis oil. In another embodiment, the concentration of chloride in the raffinate phase/upgraded pyrolysis oil is reduced by about 50% to about 60% (wt. %) relative to the concentration of chloride in the starting pyrolysis oil.

In one embodiment, the raffinate phase/upgraded pyrolysis oil will have a reduced concentration of sulphur compounds and olefins compared to the pyrolysis oil prior to mixing with the upgrading solution. Suitably, the concentrations of sulphur compounds and olefins will be reduced to the degree as recited in any of the above embodiments.

In the process of the present invention, the raffinate phase tends to be of lower density than the extract phase and thus the raffinate phase will typically be the upper phase and the extract phase will typically be the lower phase.

Typically, the process further comprises separating the raffinate phase to yield an upgraded pyrolysis oil.

The raffinate phase may be separated by any means used in the art, and is typically separated by a physical process. Said separating typically comprises physically isolating the raffinate phase, or at least some of the raffinate phase. Thus, said separating typically comprises separating at least some of the raffinate phase from the extract phase.

As the two phases will typically already be separate in the same container due to their immiscibility, said separating may simply comprise removing (e.g. by draining or decanting) at least part of the extract phase from the container comprising the extract phase and the raffinate phase. Alternatively, the raffinate phase may be removed (e.g. by draining or decanting) from the container to leave the extract phase.

In one aspect, the present invention relates to a raffinate phase obtainable by a process as defined in any of the above embodiments.

In another aspect, the present invention relates to a raffinate phase obtained by a process as defined in any of the above embodiments.

As used herein, the term "extract phase" refers to the phase typically comprising the upgrading solution, for instance, the upgrading solution after it has been mixed with the pyrolysis oil. Typically, the extract phase will comprise the majority of the upgrading solution after mixing with the pyrolysis oil. Typically, the extract phase will be more dense than the raffinate phase and will form the lower layer. In addition to the upgrading solution, the extract phase may comprise one or more undesirable substances extracted from the pyrolysis oil.

In another aspect, the present invention relates to an upgraded pyrolysis oil obtained by a process as defined in any of the above embodiments. In one embodiment, the upgraded pyrolysis oil obtained/obtainable by the process of the invention is suitable as fuel (e.g. gasoline) or for blending with fuels (e.g. gasoline).

Pyrolysis Oil

Pyrolysis oil is a substance known to the skilled person. Pyrolysis oil may be obtained from a number of sources. The present invention concerns pyrolysis oil derived from plastic, rubber or a combination thereof. In one embodiment, the pyrolysis oil to be upgraded is obtainable or obtained by pyrolysis of plastic, rubber or a combination thereof. Typically, pyrolysis is carried out at high temperature (greater than 400° C.) and with very high heating rates in the absence of oxygen.

In another embodiment, the pyrolysis oil is obtainable or obtained by pyrolysis of plastic. In another embodiment, the pyrolysis oil is obtainable or obtained by pyrolysis of rubber. In another embodiment, the pyrolysis, oil is obtainable or obtained by pyrolysis of a combination of plastic and rubber.

In one embodiment, the combination of rubber and plastic comprises at least about 50% w/w of plastic and rubber, suitably at least about 60% w/w of plastic and rubber, suitably at least about 70% w/w of plastic and rubber, suitably at least about 80% w/w of plastic and rubber, suitably at least about 90% w/w of plastic and rubber, suitably at least about 95% w/w of plastic and rubber.

In another embodiment, the combination of plastic and rubber comprises about 50% to about 100% (w/w) of plastic and rubber, suitably about 60% to about 100% (w/w) of plastic and rubber, about 70% to about 100% (w/w) of plastic and rubber, about 80% to about 100% (w/w) of plastic and rubber, about 90% to about 100% (w/w) of plastic and rubber.

Suitably, in each of the above mentioned embodiments the rubber is obtained from tyres.

Suitably, in each of the above embodiments the plastic (essentially) consists of one or more thermoplastic polymers. Suitably, the plastic is waste plastic which may be a mixture of various plastics. Plastics may be referred to by the name of the polymer of which they consist. Examples of common plastics are polyethylene, polypropylene and polystyrene.

In one embodiment, the pyrolysis oil is obtainable or obtained by pyrolysis of waste plastic. In another embodiment, the pyrolysis oil is obtainable or obtained by pyrolysis of plastic comprising one or more of polyethylene, polypropylene and polystyrene.

In one embodiment, the waste plastic comprises at least about 50% w/w of plastic, suitably at least about 60% w/w of plastic, suitably at least about 70% w/w of plastic, suitably at least about 80% w/w of plastic, suitably at least about 90% w/w of plastic, suitably at least about 95% w/w of plastic.

In another embodiment, the waste plastic comprises about 50% to about 100% (w/w) of plastic, suitably about 60% to about 100% (w/w) of plastic, about 70% to about 100% (w/w) of plastic, about 80% to about 100% (w/w) of plastic, about 90% to about 100% (w/w) of plastic.

In one embodiment, the pyrolysis oil to be upgraded has a specific gravity (20/4) of about 1 or less, suitably about 0.95 or less, or about 0.90 or less. In one embodiment, the pyrolysis oil to be upgraded has a specific gravity (20/4) of from about 0.7 to about 0.95, suitably about 0.8 to about 0.95, or about 0.7 to about 0.85.

In on embodiment, the pyrolysis oil to be upgraded is not miscible with water at standard ambient temperature and pressure (SATP), i.e. at a temperature of 298.15 K (25° C.) and at 100,000 Pa (1 bar, 14.5 psi, 0.9869 atm).

Suitably, the pyrolysis oil to be upgraded is not miscible with water at standard ambient, temperature and pressure (SATP), i.e. at a temperature of 298.15 K (25° C.) and at 100,000 Pa (1 bar, 14.5 psi, 0.9869 atm), and has a specific gravity (20/4) of from about 0.7 to about 0.95, suitably about 0.8 to, about 0.95, or about 0.7 to about 0,85.

Upgrading Solution

The processes of the invention utilise an upgrading solution. As used herein, an upgrading solution refers to a solution or liquid mixture capable of reducing/removing one or more undesirable substances from a pyrolysis oil.

In one embodiment, the upgrading solution is capable of removing or reducing the concentration of undesirable substances in the pyrolysis oil, wherein the undesirable substances are selected from one or more of solid residues, heteroatom compounds and olefins. Suitably, the undesirable substances are selected from one or more of solid residues, sulphur compounds, halogen compounds (e.g chloride), nitrogen compounds and olefins.

The upgrading solution comprises a polar organic solvent. As used herein, the term polar organic solvent refers to refers to an organic solvent typically having a dipole moment (D) of greater than or equal to about 1.5 at 298° K. For instance, methanol has a dipole moment (D) of 1.7 (at 298° K). Tables of dipole moments of solvents are readily available to the skilled person.

In one embodiment, the polar organic solvent has a dipole moment (D) at 298° K of about 1.5 or more, suitably about 2.0 or more, suitably about 2.5 or more, suitably about 3 or more, suitably about 3.5 or more.

In another embodiment, the polar organic solvent has a dipole moment (D) at 298° K of about 1.5 to about 6.0, suitably about 1.5 to about 5.5, suitably about 1.5 to about 5.0.

In another embodiment, the polar organic solvent has a dipole moment (D) at 298° K of about 2.0 to about 6.0, suitably about 2.0 to about 5.5, suitably about 2.0 to about 5.0.

In another embodiment, the polar organic solvent has a dipole moment (D) at 298° K of about 2.5 to about 6.0, suitably about 2.5 to about 5.5, suitably about 2.5 to about 5.0.

In another embodiment, the polar organic solvent has a dipole moment (D) at 298° K of about 2.5 to about 6.0, suitably about 2.5 to about 5.5, suitably about 2.5 to about 5.0.

In another embodiment, the polar organic solvent has a dipole moment (D) at 298° K of about 3.0 to about 6.0, suitably about 3.0 to about 5.5, suitably about 3.0 to about 5.0.

In another embodiment, the polar organic solvent has a dipole moment (D) at 298° K of about 3.5 to about 6.0, suitably about 3.5 to about 5.5, suitably about 3.5 to about 5.0.

In another embodiment, the polar organic solvent has a dipole moment (D) at 298° K of about 4.0 to about 6.0, suitably about 4.0 to about 5.5, suitably about 4.0 to about 5.0.

In another embodiment, the polar organic solvent has a dipole moment (D) at 298° K of about 4.5 to about 6.0, suitably about 4.5 to about 5.5, suitably about 4.5 to about 5.0.

In one embodiment, the polar organic solvent is selected from one or more of an alcohol, a carbonate, an amide, an organosulphur compound, a nitrile and a heterocyclic compound. In another embodiment, the polar organic solvent is selected from one or more of an alcohol, a carbonate, an amide and an organosulphur compound. In another embodiment, the polar organic solvent is selected from one or more of an alcohol, a carbonate, and an organosulphur compound.

In one embodiment, the polar organic solvent is an alcohol. Suitably, the polar organic solvent may be any $C_{1-10}$ alcohol, typically a $C_{1-4}$ alcohol. An alcohol may have the structure alkyl-OH, HO-alkylene-OH, alkenyl-OH, OH-alkenylene-OH, cycloalkyl-OH, or OH-cycloalkylene-OH.

In one embodiment, the polar organic solvent is an alcohol selected from methanol, ethanol and n-propanol, i-propanol, n-butanol, s-butanol, i-butanol and t-butanol, pentanol, methyl glycol, glycerol, ethane-1,2-diol (ethylene glycol), propane-1,2-diol (propylene glycol) and sorbitol.

In another embodiment, the polar organic solvent comprises/essentially consists of/consists of methanol or ethanol. In another embodiment, the polar organic solvent comprises/essentially consists of consists of methanol.

In another embodiment, the polar organic solvent is a carboxylic acid. Examples of carboxylic acids which the upgrading solution may comprise include methanoic acid (formic acid), ethanoic acid (acetic acid), propanoic acid, butanoic acid and pentanoic acid.

In another embodiment, the polar organic solvent is a carbonate. The upgrading solution may further comprise may be any $C_{3-10}$ carbonate. A carbonate typically has the structure alkyl-OC(O)O-alkyl. Examples of the carbonate that the upgrading solution may comprise include dimethylcarbonate, ethylmethylcarbonate, diethyl carbonate, propylene carbonate and trimethylene carbonate. Suitably, the upgrading solution comprises propylene carbonate.

In one embodiment, the polar organic solvent is an amide. Suitably, the polar organic solvent may be a $C_{2-10}$ amide. An amide typically has the structure alkyl-$CONH_2$, alkyl-CONH(alkyl) or alkyl-$CON(alkyl)_2$.

Examples of the amide which the upgrading solution may comprise include formamide, N-methyl formamide, dimethyl formamide (DMF), dimethyl acetamide (DMA), N-vinylacetamide, pyrrolidone, N-methyl pyrrolidone (NMP) (also known as N-methyl-2-pyrrolidone), and N-vinyl pyrrolidone.

In one embodiment, the polar organic solvent is an organosulphur compound. Suitably, a sulfoxide or a sulphone. The sulphonefsulfoxide compound which the upgrading solution may further comprise may be a $C_{2-10}$ sulphone/sulfoxide compound. For instance, the upgrading solution may comprise dimethylsulfoxide (DMSO) or sulfolane. Suitably, the upgrading solution comprises sulfolane.

In one embodiment, the polar organic solvent is a heterocyclic compound. The heterocyclic compound which the upgrading solution may comprise may be any $C_{3-10}$ heterocyclic compound. The heterocyclic compound may be any compound having from 3 to 10 carbon atoms and comprising a ring, which ring comprises a heteroatom selected from N, P, O and S. The upgrading solution may comprise a heterocyclic compound selected from furan, tetrahydrofuran, thiophene, pyrrole, pyrroline, pyrrolidine, dioxolane, oxazole, thiazole, imidazole, imidazoline, imidazolidine, pyrazole, pyrazoline, pyrazolidine, izoxazole, isothiazole, oxadiazole, pyran, pyridine, piperidine, pyridazine, and piperazine. For instance, the upgrading solution may comprise pyridine.

In one embodiment, the polar organic solvent is a nitrite compound. The nitrite which the upgrading solution may further comprise may be a $C_{2-10}$ nitrile. For instance, the upgrading, solution may comprise acetonitrile or propionitrile.

In one embodiment, the polar organic solvent is selected from methanol, ethanol, ethylene glycol, propylene carbonate, sulfolane, acetic acid, propanoic acid, DMSO, NMP, DMF, DMA and pyridine. Suitably, the polar organic solvent is selected from methanol, ethanol, ethylene glycol, propylene carbonate, sulfolane, acetic acid and propanoic acid. Suitably, the polar organic solvent is selected from methanol, ethanol, ethylene glycol, propylene carbonate and sulfolane. Suitably, the upgrading solution comprises one or more of sulfolane and propylene carbonate.

Suitably, the polar organic solvent is selected from methanol, ethanol, ethylene glycol, propylene carbonate, NMP, sulfolane, acetic acid and propanoic acid. Suitably, the polar organic solvent is selected from methanol, ethanol, ethylene glycol, NMP, propylene carbonate and sulfolane. Suitably, the upgrading solution comprises one or more of NMP, sulfolane and propylene carbonate.

The upgrading solution may comprise further solvents such as an alcohol, an aldehyde, a ketone, an ether, a carboxylic acid, an ester, a carbonate, an acid anhydride, an amide, an amine, a heterocyclic compound, an imine, an imide, a nitrile, a nitro compound, a sulfoxide, and a haloalkane.

In another embodiment, the upgrading solution may further comprise one or more of another solvent, acid, base or organometallic compound.

In another embodiment, the upgrading solution may further a further solvent selected from an alcohol, an aldehyde, a ketone, an ether, an ester, a carbonate, an amide, an amine, a heterocyclic compound, an imine, a nitrile, a nitro compound, a haloalkane, and a sulfoxide.

The alcohol which the upgrading solution may further comprise may be any $C_{1-10}$ alcohol, typically a $C_{1-4}$ alcohol. Examples of alcohols which the upgrading solution may comprise include: monohydric alcohols such as methanol, ethanol, propanol, isopropanol (propan-2-ol), butanol (butan-1-ol), s-butanol (butan-2-ol), i-butanol (2-methylpropan-l-ol), t-butanol (2-methylpropan-2-ol), cyclopentanol, pentanol, cyclohexanol, hexanol, heptanol and octanol; and polyhydric alcohols such as ethane-1,2-diol (ethylene glycol), propane-1,2-diol (propylene glycol), propane-1,3-diol, propane-1,2,3-triol (glycerol), isopropanediol, butanediol, isobutanediol, tertbutanediol, butanetriol, pentanediol, methylbutanediol, hexanediol, hexanetriol. For compounds wherein the positions of hydroxy groups are not specified, alcohols having each of the possible positions are covered. Thus, butanediol includes butane-1,2-diol, butane-1,3-diol, butane-1,4-diol and butane-2,3-diol. Ethane-1,2-diol (ethylene glycol), propane-1,2-diol (propylene glycol), propane-1,3-diol, isopropanediol, and butanediol are examples of dihydric alcohols.

The aldehyde which the upgrading solution may further comprise may be any $C_{1-10}$ aldehyde, typically a $C_{3-6}$ aldehyde. An aldehyde typically has the structure alkyl-CHO. Examples of aldehydes which the upgrading solution may comprise include methanol (formaldehyde), ethanal (acetaldehyde), propanal, butanal, pentanal and hexanal.

The ketone which the upgrading solution may further comprise may be any $C_{3-10}$ ketone. A ketone typically has the structure alkyl-C(O)-alkyl, cycloalkyl-C(O)-alkyl, or aryl-C(O)-alkyl. The ketone may be linear, branched, or cyclic. Examples of ketones which the upgrading solution may comprise include propanone (acetone), butanone, pentan-2-one, pentan-3-one, ethyl isopropyl ketone, hexan-2-one, and hexan-3-one.

The ether which the upgrading solution may further comprise may be any $C_{2-10}$ ether, i.e. an ether containing from 2 to 10 carbon atoms. An ether typically has the structure alkyl-O-alkyl or that of an alicyclic ether. The ether may be linear, branched or cyclic. Examples of ethers which the upgrading solution may further comprise include diethyl ether, ethyl isopropyl ether, dipropyl ether, diisopropyl ether and tetrahydrofuran.

The ester which the upgrading solution may further comprise may be any $C_{2-10}$ ester. For instance, the ester may be a $C_{1-5}$ alkyl $C_{1-6}$ carboxylate. An ester typically has the structure alkyl-COO-alkyl. Examples of the ester which the upgrading solution may comprise include methyl formate, ethyl formate, methyl acetate, ethyl acetate, vinyl acetate, propyl acetate, isopropyl acetate, butyl acetate, isobutyl acetate, tertbutyl acetate, pentyl acetate, methyl propanoate, ethyl propanoate, propyl propanoate, and ethyl isopropanoate.

The carbonate which the upgrading solution may further comprise may be any $C_{3-10}$ carbonate. A carbonate typically has the structure alkyl-OC(O)O-alkyl. Examples of the carbonate that the upgrading solution may comprise include dimethylcarbonate, ethylmethylcarbonate and diethyl carbonate. The carbonate may be propylene, carbonate or trimethylene carbonate. The acid anhydride which the upgrading solution may comprise may be any C4-8 acid anhydride. An example of the acid anhydride which the upgrading solution may comprise is acetic anhydride.

The amide which the upgrading solution may further comprise be any $C_{2-10}$ amide. An amide typically has the structure alkyl-$CONH_2$, alkyl-CONH(alkyl) or alkyl-CON$(alkyl)_2$.

Examples of the amide which the upgrading solution may further comprise include formamide, N-methyl formamide, dimethyl formamide, dimethyl acetamide, N-vinylacetamide, pyrrolidone, N-methyl pyrrolidone, and N-vinyl pyrrolidone.

The amine which the upgrading solution may further comprise may be any $C_{2-15}$ amine. An amine typically has the structure $RNH_2$, $R_2NH$, $R_3N$, and $H_2NR'NH_2$ where R may be selected from $C_{2-10}$ alkyl, $C_{2-10}$ alkenyl, $C_{2-12}$ alkynyl, $C_{6-10}$ aryl, and $C_{6-12}$ arylalkyl, and R' may be selected from $C_{2-10}$ alkylene, $C_{2-10}$ alkenylene, $C_{2-10}$ alkynylene, $C_{5-10}$ cycloalkylene, and $C_{6-10}$ arylene. The amine may be a primary, secondary or tertiary amine. The amine may comprise one or more, or two or more amine groups. The amine may be, selected from mono-$C_{2-15}$-alkylamines, di-$C_{1-7}$-alkylamines and tri-$C_{1-5}$-alkylamines. The amine may be a $C_{2-10}$-alkylenediamine. Examples of the amine which the upgrading solution may comprise include ethylamine, triethylamine, tripropylamine, tributylamine, ethylenediamine, propylenediamine, diethylenetriamine, morpholine, piperidine, and quinoline.

The heterocyclic compound which the upgrading solution may further comprise may be any $C_{3-10}$ heterocyclic compound. The heterocyclic compound may be any compound having from 3 to 10 carbon atoms and comprising a ring, which ring comprises a heteroatom selected from N, P, O and S. The upgrading solution may comprise a heterocyclic compound selected from furan, tetrahydrofuran, thiophene, pyrrole, pyrroline, pyrrolidine, dioxolane, oxazole, thiazole, imidazole, imidazoline, imidazolidine, pyrazole, pyrazoline, pyrazolidine, izoxazole, isothiazole, oxadiazole, pyran, pyridine, piperidine, pyndazine, and piperazine. For instance, the upgrading solution may further comprise pyridine, furan or tetrahydrofuran.

The imine which the upgrading solution may further comprise may be a $C_{4-10}$ imine. The imide which the upgrading solution may further comprise may be a $C_{4-10}$ imide.

The nitrile which the upgrading solution may further comprise may be a $C_{2-10}$ nitrite. For instance, the upgrading solution may comprise acetonitrile or propionitrile.

The nitro compound which the upgrading solution may further comprise may be a $C_{1-10}$ nitro compound. For instance, the upgrading solution may comprise nitromethane, nitroethane, nitropropane or nitrobenzene.

The sulfoxide compound which the upgrading solution may further comprise may be a $C_{2-10}$ sulfoxide compound. For instance, the upgrading solution may comprise dimethylsulfoxide (DMSO). The upgrading solution may further comprise diethylsulfoxide or methylethylsulfoxide.

The haloalkane which the upgrading solution may further comprise may be any $C_{1-10}$ haloalkane. For instance, the upgrading solution may further comprise dichloromethane (DCM), trichloromethane, tetrachloromethane or dichloroethane.

In a particular embodiment, the upgrading solution may further comprise a solvent selected from methanol, ethanol, propanol, isopropanol, ethylene glycol, propylene glycol, and propane-1,3-diol.

The acid which the upgrading solution may further comprise may be any $C_{1-8}$ carboxylic acid. A carboxylic acid typically has the structure alkyl-COOH. The carboxylic acid may be, linear, branched or cyclic. Examples of carboxylic acids which the upgrading solution may comprise include methanoic acid (formic acid), ethanoic acid (acetic acid), propanoic acid, butanoic acid and pentanoic acid.

Suitably, the acid is present in an amount of from about 0.5 to about 20 wt. %, suitably about 0.5 to about 15 wt. %, 0.5 to about 10 wt. %, 0.5 to about 5 wt. %. Suitably, the acid is present in an amount of from about 1 to about 20 wt. %, suitably about 1 to about 15 wt. %, 1 to about 10 wt. %, 1 to about 5 wt. %, suitably about 1%.

The base which the upgrading solution may further comprises may be any alkali metal hydroxide or carbonate. Examples includes potassium hydroxide, sodium hydroxide, lithium hydroxide, caesium hydroxide, potassium carbonate, sodium carbonate, lithium carbonate and caesium carbonate. Suitably, the base is selected from potassium hydroxide, sodium hydroxide, sodium carbonate and potassium carbonate. Suitably, the base is, selected from potassium hydroxide and sodium hydroxide.

Suitably, the base is present in an amount of from about 0.5 to about 20 wt. %, suitably about 0.5 to about 15 wt. %, 0.5 to about 10 wt. %, 0.5 to about 5 wt. %. Suitably, the acid is present in an amount of from about 1 to about 20 wt. %, suitably about 1 to about 15 wt. %, 1 to about 10 wt. %, 1 to about 5 wt. %, suitably about 1%.

The organometallic compound which the upgrading solution may further comprises may be any alkali metal salt. Examples include potassium acetate, sodium acetate, potassium formate and sodium formate. In one embodiment, the organometallic compound is potassium acetate or sodium acetate.

Suitably, the organometallic compound is present in an amount of from about 0.5 to about 20 wt. %, suitably about 0.5 to about 15 wt. %, 0.5 to about 10 wt. %, 0.5 to about 5 wt. %. Suitably, the acid is present in an amount of from about 1 to about 20 wt. %, suitably about 1 to about 15 wt. %, 1 to about 10 wt. %, 1 to about 5 wt. %, suitably about 1%.

In one embodiment, the upgrading solution has a specific gravity (20/4) of about 0.95 or more, suitably about 1.00 or more, suitably about 1.05 or more In one embodiment, the upgrading solution comprises a polar organic solvent selected from one of NMP, DMF, DMSO, sulfolane and propylene carbonate. Suitably, the upgrading solution comprises at least about 50% wt. of one or more of NMP, DMF, DMSO, sulfolane and propylene carbonate, suitably sulfolane or propylene carbonate.

In another embodiment, the upgrading solution comprises at least about 50% wt. of one or more of sulfolane and propylene carbonate, suitably, at least about 60% wt, suitably at least about 70% wt., suitably at least about 80% wt., suitable at least about 90% wt. of one or more of sulfolane and propylene carbonate.

In another embodiment, the upgrading solution comprises at least about 50% wt. of one or more of NMP, sulfolane and propylene carbonate, suitably, at least about 60% wt, suitably at least about 70% wt., suitably at least about 80% wt., suitable at least about 90% wt. of one or more of NMP, sulfolane and propylene carbonate.

In one embodiment, the upgrading solution comprises at least about 50% wt. of one or more of sulfolane and propylene carbonate, and further comprises an alcohol selected from methanol, ethanol, and ethane-1,2-diol.

In one embodiment, the upgrading solution comprises at least about 50% wt. of one or more of sulfolane and propylene carbonate, and further comprises an alcohol selected from methanol, ethanol, and ethane-1,2-diol, and a base or organometallic compound. Suitably, the base is potassium carbonate and the organometallic compound is potassium acetate.

In another embodiment, the upgrading solution comprises at least about 50% wt. of one or more of sulfolane and propylene carbonate, and further comprises an acid selected from ethanoic acid (acetic acid) sand propanoic acid.

In one embodiment the upgrading solution comprises sulfolane, methanol and potassium hydroxide; or sulfolane, ethylene glycol and potassium hydroxide; or propylene carbonate and acetic acid; or propylene carbonate, ethylene glycol and potassium acetate.

In one embodiment the upgrading solution comprises NMP and water. In another embodiment, the upgrading solution essentially consists of NMP and water. In another embodiment the upgrading solution consists of NMP and water. In another embodiment the upgrading solution is a mixture of NMP and water.

Suitably, the NMP and water mixture comprises at least about 50% (v/v) of NMP. Alternatively, at least about 60% (v/v) of NMP, at least about 70% (v/v) of NMP, at least about 80% (v/v) of NMP, at least about 90% (v/v) of NMP, or at least about 95% (v/v) of NMP.

In one embodiment, the upgrading solutions comprises NMP and water wherein the ratio of NMP to water (v/v) is about 1:1 to about 10:1, suitably about 2:1 to about 10:1, suitably about 3:1 to about 10:1, suitably about 4:1 to, about 10:1, suitably about 5:1 to about 10:1.

In another embodiment, the upgrading solutions comprises NMP and water wherein the ratio of NMP to water (v/v) is about 1:1 to about 9:1, suitably about 2:1 to about 9:1, suitably about 3:1 to about 9:1, suitably about 4:1 to about 90:1, suitably about 5:1 to about 9:1.

In one embodiment the upgrading solution comprises about 90% NMP and about 10% water. In another embodiment, the upgrading solution essentially consists of about 90% NMP and about 10% water. In another embodiment the upgrading, solution consists of about 90% NMP and about 10% water. In another embodiment the upgrading solution is a mixture of about 90% NMP and about 10% water.

Optionally, once the upgrading solution has been added to the pyrolysis oil, the resulting mixture may be treated with a hydrocarbon fluid in order to assist phase separation. In one embodiment, the hydrocarbon fluid is an alkane or an alkene, or a mixture thereof. Suitably the hydrogen carbon fluid is a saturated hydrocarbon fluid. In one embodiment, the hydrocarbon fluid comprises one or more hydrocarbons selected from $C_5$-$C_{16}$ alkanes and alkenes.

Suitably, the hydrocarbon fluid may be a $C_1$-$C_{20}$ alkane or alkene or mixture thereof; suitably a $C_2$-$C_{20}$ alkane or alkene or mixture thereof; suitably a $C_3$-$C_{20}$ alkane or alkene or mixture thereof; suitably a $C_4$-$C_{20}$ alkane or alkene or mixture thereof; suitably a $C_5$-$C_{20}$ alkane or alkene or mixture thereof suitably a $C_5$-$C_{16}$ alkane or alkene or mixture thereof.

In one embodiment, the hydrocarbon fluid is a liquid at standard temperature and pressure.

In one embodiment, the hydrocarbon fluid is selected from propane, butane, pentane, hexane, heptane, octane, nonane, decane, undecane, dodecane, tridecane and tetradecane, hexadecane (cetane), cyclopentane, cyclohexane, methylcyclopentane, cycloheptane, methylcyclahexane, dimethylcyclopentane and cyclooctane and mixtures thereof.

In another embodiment, the hydrocarbon fluid is selected from pentane, hexane, heptane, octane, nonane, decane, undecane, dodecane, tridecane and tetradecane, hexadecane (cetane), cyclopentane, cyclohexane, methylcyclopentane, cycloheptane, methylcyclohexane, dimethylcyclopentane and cyclooctane and mixtures thereof.

In another embodiment, the hydrocarbon fluid is selected from pentane, hexane, heptane, octane, nonane, decane, undecane, dodecane, tridecane, tetradecane, and hexadecane (cetane) and mixtures thereof.

In one aspect, the present invention relates to the use of an upgrading solution for decreasing the heteroatom content of a pyrolysis oil, wherein the upgrading solution comprises a polar organic solvent, and wherein the pyrolysis oil is a derived from the pyrolysis of plastic or rubber, or a combination thereof.

In one aspect, the present invention relates to the use of an upgrading solution for decreasing the olefin content of a pyrolysis oil, wherein the upgrading solution comprises a polar organic solvent, and wherein the pyrolysis oil is a derived from the pyrolysis of plastic or rubber, or a combination thereof.

In another aspect, the present invention relates to the use of an upgrading solution for decreasing the solid residue content of a pyrolysis oil, wherein the upgrading solution comprises a polar organic solvent; and wherein the pyrolysis oil is a derived from the pyrolysis of plastic or rubber, or a combination thereof.

Suitably, the upgrading solution is as defined in any of the above mentioned embodiments.

Washing Step

In one embodiment, prior to treatment of the pyrolysis oil with the upgrading solution, the pyrolysis oil may be treated with an aqueous solution.

Accordingly, in one embodiment, the present invention relates to a process for producing an upgraded pyrolysis oil product comprising:

(i) treating a pyrolysis oil with an aqueous solution to provide a mixture comprising an organic phase and an aqueous phase and separating the organic phase;
(ii) treating the separated organic phase of step (i) with an upgrading solution to provide a mixture comprising an extract phase and a raffinate phase;
(iii) separating the raffinate phase from the extract phase to yield an upgraded pyrolysis oil product;
wherein the pyrolysis oil is a derived from the pyrolysis of plastic or rubber, or a combination thereof.

In another embodiment, prior to treatment of the pyrolysis oil with the upgrading solution, the pyrolysis oil may be treated with an aqueous solution and a hydrocarbon fluid. Suitably, the pyrolysis oil is treated simultaneously with an aqueous solution and a hydrocarbon fluid.

Accordingly, in one embodiment, the present invention relates to a process for producing an upgraded pyrolysis oil product comprising:

(i) treating a pyrolysis oil with an aqueous solution and a hydrocarbon fluid to provide a mixture comprising an organic phase and an aqueous phase and separating and optionally filtering the organic phase;
(ii) treating the separated organic phase of step (i) with an upgrading solution to provide a mixture comprising an extract phase and a raffinate phase;
(iii) separating the raffinate phase from the extract phase to yield an upgraded pyrolysis oil product;
wherein the pyrolysis oil is a derived from the pyrolysis of plastic or rubber, or a combination thereof.

In another embodiment, the present invention relates to a process for producing an upgraded pyrolysis oil product comprising:

(i) treating a pyrolysis oil with an aqueous solution to form a mixture consisting of an organic phase and an aqueous phase, and separating the organic phase from the aqueous phase;
(ii) treating the organic phase with a hydrocarbon fluid and optionally filtering the treated organic phase;
(iii) treating the filtered organic phase of step (ii) with an upgrading solution to provide a mixture comprising an extract phase and a raffinate phase;
(iv) separating the raffinate phase from the extract phase to yield an upgraded pyrolysis oil product;
wherein the pyrolysis oil is a derived from the pyrolysis of plastic or rubber, or a combination thereof.

In another embodiment, the present invention relates to a process for producing an upgraded pyrolysis oil product comprising.

(i) treating a pyrolysis oil with a hydrocarbon fluid and optionally filtering the mixture;
(ii) treating the mixture of step (i) with an aqueous solution to form a second mixture consisting of an organic phase and an aqueous phase, and separating the organic phase from the aqueous phase;
(iii) treating the separated organic phase of step (ii) with an upgrading solution to provide a mixture comprising an extract phase and a raffinate phase;
(iv) separating the raffinate phase from the extract phase to yield an upgraded pyrolysis oil product;
wherein the pyrolysis oil is a derived from the pyrolysis of plastic or rubber, or a combination thereof.

The pyrolysis oil and the aqueous solution may be mixed by any means known in the art. For instance, the pyrolysis oil and aqueous solution may be added to vessels, reactors or mixers commonly used in the art and the two components may be mixed. Mixing may comprise vigorous agitation of the two components by a mixing means. For instance, the two components may be mixed together by stirring or by shaking.

The mixing of the two components may occur more than once. For instance, after mixing the pyrolysis oil and the aqueous solution for the first time, the resulting two phases may be mixed again, possible numerous times. The steps of contacting and formation of two phases may be continuous. Thus, the two components may pass through a mixing means before entering a separating chamber in which the first and second phases are formed. The contacting of the two components may be performed using a propeller, counter-current flow means, an agitation means, a Scheibel® column, a KARR® column or a centrifugal extractor.

The pyrolysis oil may be repeatedly mixed multiple times with fresh batches of aqueous solution. For instance, the pyrolysis oil may be mixed with a first batch of an aqueous solution to provide a first organic phase and a first aqueous phase. Following separation of the organic phase from the aqueous phase, the organic phase may be mixed with a second batch of the aqueous solution to provide a second organic phase and a second aqueous phase. This cycle may be repeated multiple times.

In one embodiment the cycle of mixing the pyrolysis oil/separated organic phase with aqueous solution is repeated, between 1 and 9 times. In another embodiment, the cycle is repeated between 1 and 4 times. In another embodiment, the cycle is repeated 1, 2, 3 or 4 times. In another embodiment, the cycle is repeated 4 times.

Typically, the pyrolysis oil and aqueous solution are mixed to the extent to allow effective washing of the pyrolysis oil by the aqueous solution. In respect of two immiscible solutions, the skilled person would understood that typically these solutions are intimately mixed until an emulsion is formed which is subsequently allowed to separate into two phases.

In one embodiment, the mixing is carried out at ambient temperature and pressure. Typically, a temperature of between about 18 to 28° C., more typically between about 21 and 25° C., and a pressure of about 100 kPa. Accordingly, expense and other problems associated with high temperature or pressure conditions are avoided.

Alternatively, the mixing is carried out at a temperature between about 0° C. and about 70° C., suitably about 15° C. to about 50° C.

Typically, the mass ratio of pyrolysis oil to aqueous solution is from about 95:5 to about 10:90. In one embodiment, the mass ratio of pyrolysis oil to aqueous solution is about 95:5 to about 50:50, or suitably about 95:5 to about 60:40, or suitably about 95:5 to about 70:30 or suitably about 95:5 to about 80:20. In one embodiment, the mass ratio of pyrolysis oil to aqueous solution is about 90:10.

In another embodiment, the mass ratio of pyrolysis oil to aqueous solution is from about 70:30 to about 30:70, or suitably about 60:40 to about 40:60, or suitably about 50:50.

In one embodiment, the organic phase will have a reduced concentration of salts, acids and other water soluble components compared to the pyrolysis oil prior to mixing with the upgrading solution. In another embodiment, the organic phase will have a reduced concentration of solid residue compared to the pyrolysis oil prior to mixing with the upgrading solution.

In the process of the present invention, the organic phase tends to be of lower density than the extract phase and thus the organic phase will typically be the upper phase and the aqueous phase will typically be the lower phase.

Typically, the process further comprises separating the organic phase. The organic phase may be separated by any means used in the art, and is typically separated by a physical process. Said separating typically comprises physically isolating the organic, phase, or at least some of the organic phase. Thus, said separating typically comprises separating at least some of the organic phase from the aqueous phase.

As the two phases will typically already be separate in the same container due to their immiscibility, said separating may simply comprise removing (e.g. by draining or decanting) at least part of the aqueous phase from the container comprising the aqueous phase and the organic phase. Alternatively, the organic phase may be removed (e.g. by draining or decanting) from the container to leave the aqueous phase.

In one embodiment, the pyrolysis oil is treated with the aqueous solution prior to treatment with the hydrocarbon fluid. In another embodiment, the pyrolysis oil is treated with the aqueous solution separately from the treatment with the hydrocarbon fluid. In another embodiment, the pyrolysis oil is treated with the aqueous solution prior to, and separately from the treatment with the hydrocarbon fluid. In another embodiment, the pyrolysis oil is treated simultaneously with the aqueous solution and the hydrocarbon fluid.

The (washed) pyrolysis oil and the hydrocarbon fluid may be mixed by any means known in the art. For instance, the (washed) pyrolysis oil and the hydrocarbon fluid may be added to vessels, reactors or mixers commonly used in the art and the two components may be mixed. Mixing may comprise vigorous agitation of the two components by a mixing means. For instance, the two components may be mixed together by stirring or by shaking.

In one embodiment, the mixing is carried out at ambient temperature and pressure. Typically, a temperature of between about 18 to 28° C., more typically between about 21 and 25° C., and a pressure of about 100 kPa. Accordingly, expense and other problems associated with high temperature or pressure conditions are avoided.

Alternatively, the mixing is carried out at a temperature between about 0° C. and about 70° C., suitably about 15° C. to about 50° C.

Typically, the mass ratio of (washed) pyrolysis oil to hydrocarbon fluid is from about 95:5 to about 10:90. In one embodiment, the mass ratio of pyrolysis oil to upgrading solution is about 70:30 to about 30:70, or suitably about 60:40 to about 40:60, or suitably about 50:50.

In one embodiment the organic phase/hydrocarbon mixture is treated in order to remove any solid particles. This may be done by any suitable means in the art. The skilled person would be aware of suitable techniques to remove any solid particles, such as filtration. Suitably the organic phase/hydrocarbon mixture is filtered.

In one embodiment, the organic phase/hydrocarbon mixture will have a reduced concentration of solid residue, such as coke or asphaltenes compared to the pyrolysis oil prior to mixing with the hydrocarbon fluid.

Aqueous Solution

In one embodiment, the aqueous solution has a pH of about 5 to about 10, suitably a pH of about 5 to about 9, suitably a pH of about 5 to 8. In another embodiment, the aqueous solution has a pH of about 6 to about 10, suitably a pH of about 6 to about 9, suitably a pH of about 6 to 8.

In one embodiment, the aqueous solution may comprise an acid, suitably a $C_{1-8}$ carboxylic acid. A carboxylic acid typically has the structure alkyl-COOH. The carboxylic acid may be linear, branched or cyclic. Examples of carboxylic acids which the aqueous solution may comprise include methanoic acid (formic acid), ethanoic acid (acetic acid), propanoic acid, butanoic acid and pentanoic acid.

Suitably, the acid is present in an amount of from about 0.5 to about 20 wt. %, suitably about 0.5 to about 15 wt. %, 0.5 to about 10 wt. %, 0.5 to about 5 wt. %. Suitably, the acid is present in an amount of from about 1 to about 20 wt. %, suitably about 1 to about 15 wt. %, 1 to about 10 wt. %, 1 to about 5 wt. %, suitably about 1%.

In one embodiment, the aqueous solution may comprise a base. The base may be any alkali metal hydroxide or carbonate. Examples includes potassium hydroxide, sodium hydroxide, lithium hydroxide, caesium hydroxide, potassium carbonate, sodium carbonate, lithium carbonate and caesium carbonate. Suitably, the base is selected from potassium hydroxide, sodium hydroxide, sodium carbonate and potassium carbonate. Suitably, the base is selected from potassium hydroxide and sodium hydroxide.

Suitably, the base is present in an amount of from about 0.5 to about 20 wt. %, suitably about 0.5 to about 15 wt. %, 0.5 to about 10 wt. %, 0.5 to about 5 wt. %. Suitably, the acid is present in an amount of from about 1 to about 20 wt. %, suitably about 1 to about 15 wt. %, 1 to about 10 wt. %, 1 to about 5 wt. %, suitably about 1%.

In one embodiment, the aqueous solution may comprise an organometallic compound, suitably an alkali metal salt. Examples includes potassium acetate, sodium acetate, potassium formate and sodium formate. In one embodiment, the organometallic compound is potassium acetate or sodium acetate.

Suitably, the organometallic compound is present in an amount of from about 0.5 to about 20 wt. %, suitably about 0.5 to about 15 wt. %, 0.5 to about 10 wt. %, 0.5 to about 5 wt. %. Suitably, the acid is present in an amount of from about 1 to about 20 wt. %, suitably about 1 to about 15 wt. %, 1 to about 10 wt. %, 1 to about 5 wt. %, suitably about 1%.

In one embodiment, the aqueous solution essentially consists of water. In another embodiment, the aqueous solution is water.

Hydrocarbon Fluid

In one embodiment, the hydrocarbon fluid is an alkane, an alkene or a mixture thereof. In one embodiment, the hydrocarbon fluid is a saturated hydrocarbon fluid. Suitably, the hydrocarbon fluid is an alkane or cycloalkane or mixture thereof. In another embodiment, the hydrocarbon fluid comprises one or more hydrocarbons selected from $C_5$-$C_{16}$ alkanes and $C_5$-$C_{16}$ alkenes.

Suitably, the alkane may be a $C_1$-$C_{20}$ alkane, suitably a $C_2$-$C_{20}$ alkane, suitably a $C_3$-$C_{20}$ alkane, suitably a $C_4$-$C_{20}$ alkane, suitably a $C_5$-$C_{20}$ alkane, suitably a $C_5$-$C_{16}$ alkane.

Suitably, the cycloalkane may be a $C_3$-$C_{20}$ cycloalkane, suitably a $C_4$-$C_{20}$ cycloalkane, suitably a $C_5$-$C_{20}$ cycloalkane, suitably a $C_5$-$C_{16}$ cycloalkane.

Suitably, the alkene may be a $C_3$-$C_{20}$ alkene, suitably a $C_4$-$C_{20}$ alkene, suitably a $C_5$-$C_{20}$ alkene, suitably a $C_5$-$C_{16}$ alkene.

In one embodiment, the hydrocarbon fluid selected from a $C_3$-$C_{20}$ alkane or alkene or mixture thereof; suitably a $C_4$-$C_{20}$ alkane or alkene or mixture thereof; suitably a $C_5$-$C_{20}$ alkane or alkene or mixture thereof; suitably, a $C_5$-$C_{16}$ alkane or alkene or mixture thereof.

In one embodiment, the hydrocarbon fluid is a liquid at standard temperature and pressure.

In one embodiment, the hydrocarbon fluid is selected from propane, butane, pentane, hexane, heptane, octane, nonane, decane, undecane, dodecane, tridecane and tetradecane, hexadecane (cetane), cyclopentane, cyclohexane, methylcyclopentane, cycloheptane, methylcyclohexane, dimethylcyclopentane and cyclooctane, or mixture thereof.

In another embodiment, the hydrocarbon fluid is selected from pentane, hexane, heptane, octane, nonane, decane, undecane, dodecane, tridecane and tetradecane, hexadecane (cetane), cyclopentane, cyclohexane, methylcyclopentane, cycloheptane, methylcyclohexane, dimethylcyclopentane and cyclooctane, or mixture thereof.

In another embodiment, the hydrocarbon fluid is selected from pentane, hexane, heptane, octane, nonane, decane, undecane, dodecane, tridecane, tetradecane, and hexadecane (cetane) or mixture thereof.

In another embodiment, the hydrocarbon fluid is selected from pentane, hexane and heptane or mixture thereof. Suitably, the hydrocarbon fluid comprises pentane. Suitably, the hydrocarbon fluid essentially consists of pentane. Suitably, the hydrocarbon fluid is pentane.

Catalytic Upgrading

In one embodiment, following treatment of the pyrolysis oil with the upgrading solution, the raffinate may be treated with a blending agent comprising a $C_{1-4}$ alcohol and the resultant feedstock contacted with a catalyst composition; wherein the catalyst composition comprises a combination of a solid acid catalyst and a sulphur removal catalyst.

Accordingly, in one embodiment, the present invention relates to a process for producing an upgraded pyrolysis oil product comprising:

(i) treating a pyrolysis oil with an upgrading solution to provide a mixture comprising an extract phase and a raffinate phase and separating the raffinate phase, wherein the upgrading solution comprises a polar organic solvent;

(ii) treating the separated raffinate phase of step (i) with a blending agent comprising a $C_{1-4}$ alcohol and contacting the resultant feedstock with a catalyst composition at a temperature of about 10° C. to about 250° C. to yield an upgraded pyrolysis oil product; wherein the catalyst composition comprises a combination of a solid acid catalyst and a sulphur removal catalyst; and wherein the pyrolysis oil is derived from the pyrolysis of plastic or rubber or mixture.

In another embodiment, the present invention relates to a process for producing an upgraded pyrolysis oil product comprising.

(i) treating a pyrolysis oil with an aqueous solution and a optionally a hydrocarbon fluid to provide a mixture comprising an organic phase and an aqueous phase and separating and optionally filtering the organic phase;

(ii) treating the separated organic phase of step (i) with an upgrading solution to provide a mixture comprising an extract phase and a raffinate phase and separating the raffinate phase, wherein the upgrading solution comprises a polar organic solvent;

(iii) treating the separated raffinate phase of step (ii) with a blending agent comprising a $C_{1-4}$ alcohol and contacting the resultant feedstock with a catalyst composition at a temperature of about 10° C. to about 250° C. to yield an upgraded pyrolysis oil product; wherein the catalyst composition comprises a combination of a solid acid catalyst and a sulphur removal catalyst; and wherein the pyrolysis oil is derived from the pyrolysis of plastic or rubber or mixture.

In another embodiment, the present invention relates to a process for producing an upgraded pyrolysis oil product comprising:

(i) treating a pyrolysis oil with an aqueous solution to form a mixture consisting of an organic phase and an aqueous phase, and separating the organic phase from the aqueous phase;

(ii) treating the organic phase with a hydrocarbon fluid and optionally filtering the treated organic phase;

(iii) treating the treated organic phase of step (ii) with an upgrading solution to provide a mixture comprising an extract phase and a raffinate phase and separating the raffinate phase, wherein the upgrading solution comprises a polar organic solvent;

(iv) treating the separated raffinate phase of step (iii) with a blending agent comprising a $C_{1-4}$ alcohol and contacting the resultant feedstock with a catalyst composition to yield an upgraded pyrolysis oil product; wherein the catalyst composition comprises a combination of a solid acid catalyst and a sulphur removal catalyst; and wherein the pyrolysis oil is derived from the pyrolysis of plastic or rubber or mixture.

In another embodiment, the present invention relates to a process for producing an upgraded pyrolysis oil product comprising:

(i) treating a pyrolysis oil with a hydrocarbon fluid and optionally filtering the mixture;

(ii) treating the mixture of step (i) with an aqueous solution to form a second mixture consisting of an organic phase and an aqueous phase, and separating the organic phase from the aqueous phase;

(iii) treating the separated organic phase of step (ii) with an upgrading solution to provide a mixture comprising an extract phase and a raffinate phase and separating the raffinate phase, wherein the upgrading solution comprises a polar organic solvent;

(iv) treating the separated raffinate phase of step (iii) with a blending agent comprising a $C_{1-4}$ alcohol and contacting the resultant feedstock with a catalyst composition to yield an upgraded pyrolysis oil product; wherein the catalyst composition comprises a combination of a solid acid catalyst and a sulphur removal catalyst; and wherein the pyrolysis oil is derived from the pyrolysis of plastic or rubber or mixture.

The raffinate/upgraded pyrolysis oil may treated with the blending agent by any means known in the art wherein some mixing take places. For instance, the raffinate/upgraded pyrolysis oil and blending agent may be added to vessels, reactors or mixers commonly used in the art and the two components may be mixed. Mixing may agitation of the two components by a mixing means. For instance, the two components may be mixed together by stirring or by shaking.

In one embodiment, the treatment with blending agent is carried out at ambient temperature and pressure. Typically, a temperature of between about 18 to 28° C., more typically between about 21 and 25° C., and a pressure of about 100 kPa. Accordingly, expense and other problems associated with high temperature or pressure conditions are avoided.

Alternatively, the mixing is carried out at a temperature between about 0° C. and about 70° C., suitably about 15° C. to about 50° C.

The process of contacting the feedstock with the catalyst corn position may be performed at ambient temperature or typically performed at an elevated temperature. Thus the process typically comprises contacting the feedstock with the catalyst composition at a temperature above ambient temperature. For instance, the temperature is typically about 25° C. or above.

In one embodiment, the feedstock is contacted with the catalyst composition at a temperature equal to or above about 40° C. for example equal to or above 50° C., for example equal to or above about 60° C., for example equal to or above about 70° C., for example equal to or above about 80° C.

In one embodiment, the feedstock is contacted with the catalyst composition at a temperature equal to or above about 100° C., for example equal to or above 250° C., for example equal to or above about 300° C., for example equal to or above about 350° C., for example equal to or above about 400° C.

In a one embodiment, the process comprises contacting the feedstock with the catalyst composition at a temperature of from about 40° C. to about 500° C., for example from about 40° C. to about 400° C., for example from about 40° C. to about 300° C., for example from about 40° C. to 200° C., for example from about 40° C. to 150° C.

In a one embodiment, the process comprises contacting the feedstock with the catalyst composition at a temperature of from about 60° C. to about 500° C., for example from about 60° C. to about 400° C. for example from about 60° C. to about 300° C., for example from about 60° C. to 200° C., for example from about 60° C. to 150° C.

In a one embodiment, the process comprises contacting the feedstock with the catalyst composition at a temperature of from about 80° C. to about 500° C., for example from about 80° C. to about 400° C., for example from about 80° C. to about 300° C., for example from about 80° C. to 200° C., for example from about 80° C. to 150° C.

In a one embodiment, the process comprises contacting the feedstock with the catalyst composition at a temperature of from about 100° C. to about 500° C., for example from about 100° C. to about 400° C., for example from about 100° C. to about 300° C., for example from about 100° C. to 200° C., for example from about 100° C. to 150° C.

In one embodiment, the process comprises contacting the feedstock with the catalyst composition at ambient pressure or above ambient pressure. For instance, the process may comprise contacting the feedstock with the catalyst composition at a pressure of about 1 atmosphere (atm) or about 101 KPa. In another embodiment, the process may comprise contacting the feedstock with the catalyst composition at a pressure of greater than about 1 atmosphere (atm) or about 101 KPa.

In one embodiment, the process comprises contacting the feedstock with the catalyst composition at a pressure of from about 101 KPa to about 1000 KPa. For example, a pressure of from about 101 KPa to about 500 KPa. For example, a pressure of from about 101 KPa to about 475 KPa. For example, a pressure of from about 101 KPa to about 450 KPa. For example, a pressure of from about 101 KPa to about 425 KPa. For example, a pressure of from about 101 KPa to about 400 KPa. For example, a pressure of from about 101 KPa, to about 375 KPa. For example, a pressure of from about 101 KPa to about 350 KPa.

Although the process may be performed batch-wise, a continuous mode may be employed. Thus, the process typically comprises continuously feeding said feedstock over the catalyst composition. In one embodiment, the process is performed using a micro-reactor. A suitable micro-reactor is a fixed bed micro-reactor.

Any suitable space velocity may be employed for feeding the feedstock over the catalyst composition. For instance, the feedstock may be fed over the catalyst composition at a weight hour space velocity (WHSV) of equal to or greater than about 0.1 $hr^{-1}$. For instance, the feedstock may be fed over the catalyst composition at a weight hour space velocity (WHSV) of equal to or greater than about 0.5 $hr^{-1}$. Suitably, the weight hour space velocity is equal to or greater than about 1.0 $hr^{-1}$, for instance equal to or greater than about 1.5 $hr^{-1}$, or for example equal to or greater than about 2.0 $hr^{-1}$.

In one embodiment WHSV is from about 0.1 $hr^{-1}$ to about 10 $hr^{-1}$. For example, a WHSV of from about 0.1 $hr^{-1}$ to about 5.0 $hr^{-1}$. For example, a WHSV of from about 0.1 $hr^{-1}$ to about 4.0 $hr^{-1}$. For example, a WHSV of from about 0.1 $hr^{-1}$ to about 3.5 $hr^{-1}$. For example, a WHSV of from about 0.1 $hr^{-1}$ to about 3.0 $hr^{-1}$. For example, a WHSV of from about 0.1 $hr^{-1}$ to about 2.5 $hr^{-1}$.

In one embodiment, the process comprises contacting the feedstock with the catalyst composition at a temperature of greater than about 40° C. to about 150° C. and a pressure of about 101 KPa.

In one embodiment, the process comprises contacting the feedstock with the catalyst composition at a temperature of greater than about 60° C. to about 120° C. and a pressure of about 101 KPa.

Feedstock

The feedstock for use in the catalytic upgrading step may comprise any raffinate product from the first aspect of the invention. Typically, the feedstock comprises an upgraded pyrolysis oil obtainable by treating a pyrolysis oil derived from pyrolysis of plastic, rubber or a combination thereof with an upgrading solution. The upgrading solution may be as described in any of the above mentioned embodiments.

The feedstock further comprises a blending agent selected from one or more $C_{1-4}$ alcohols. Suitably, the blending agent comprises one or more of methanol, ethanol, n-propanol, i-propanol, n-butanol, s-butanol, i-butanol and t-butanol. Suitably, the blending agent comprises one or more of methanol, ethanol, n-propanol and n-butanol. Suitably, the blending agent comprises one or more of methanol and ethanol.

In one embodiment, the blending agent comprises methanol in an amount of greater than or equal to about 40 wt. %. In another embodiment, the blending agent comprises methanol in an amount of about 40 wt. % to about 95 wt. %. In another embodiment, the blending agent comprises methanol in an amount of about 50 wt. % to about 95 wt. %. In another embodiment, the blending agent comprises methanol in an amount of about 60 wt. % to about 95 wt. %. In another embodiment, the blending agent comprises methanol in an amount of about 70 wt. % to about 95 wt. %. In another embodiment, the blending agent comprises methanol in an amount of about 80 wt. % to about 95 wt. %. In another embodiment, the blending agent comprises methanol in an amount of about 80 wt. %.

In one embodiment, the mass ratio of raffinate/upgraded pyrolysis oil to blending agent in the feedstock is about 99:1 to about 1:99, suitably about 90:10 to about 10:90, suitably about 80:20 to about 20:80, suitably about 70:30 to about 30:70.

In another embodiment, the mass ratio of raffinate/upgraded pyrolysis oil to blending agent in the feedstock is about 60.40 to about 10:90, suitably about 60:40 to about 20:80, suitably about 60:40 to about 30:70, suitably about 60:40 to about 40:60. In another embodiment, the mass ratio of raffinate/upgraded pyrolysis oil to blending agent in the feedstock is about 50:50.

Catalytic Composition

In one embodiment, the process of the invention comprises contacting the feedstock with a catalyst composition, wherein the catalyst composition comprises a combination of a solid acid catalyst and a sulphur removal catalyst.

Solid acid catalysts are well known to the skilled person. Well known examples include zeolites and alumina silicates.

In one embodiment, the solid acid catalyst may be an acidic zeolite. As the skilled person will appreciate, aluminosilicate zeolites comprise $SiO_4$ and $AlO_4$ tetrahedra, and each $AlO_4$ tetrahedron, with its trivalent aluminium, bears an extra negative charge, which is balanced by mono-, bi- or tri-valent cations. Such zeolites are often prepared in their sodium form. However, surface acidity can be generated (to produce an acidic zeolite) by replacing $Na^+$ by $H^+$. Protons, can be introduced into the structure through ion-exchanged forms, hydrolysis of water, or hydration of cations or reduction of cations to a lower valency state. In the case of hydrogen zeolites, protons associated with the negatively charged framework aluminium are the source of Brönsted acid activity and a linear relationship between catalytic activity and the concentration of protonic sites associated with framework aluminium has been demonstrated (W. O. Haag et al., Nature, 309, 589, 1984).

In one embodiment, the solid acid catalyst is a hydrogen zeolite (an H-zeolite) For instance, H-ZSM-5, H-Beta, H—Y or H-Mordenite.

In another embodiment, acidic silicon aluminium phosphate (SAPO) zeolites may also be employed, for instance SAPO-34. SBA is also a suitable zeolite catalyst that may be employed.

In another embodiment, the solid acid catalyst may be used in combination with a mixed metal oxide. Examples of metal oxides and acidic mixed metal oxides that may be suitably employed are ZnO, $VOPO_4$ (e.g. $VOPO_4 2H_2O$), $ZrO_2/WO_3^{2-}$, $ZrO_2/SO_4^{2-}$, $Al_2O_3/PO_4^{3-}$, $Al_2O_3/TiO_2/ZnO$, $Al_2O_3/ZrO_2/WO_3$ and $TiO_2/SO_4^{2-}$.

In another embodiment, the solid acid catalysts may be a solid heteropolyacids. Suitable solid heteropolyacids include, for example, $Cs_xH_x$-$3PW_{12}O_{40}$, $H_3PW_{12}O_{40}$·$6H_2O$, $H_3PW_{12}O_{40}$/K-10 clay, $Ag_{0.5}H_{2.5}PW_{12}O_{40}$, $Zr_{0.7}H_{0.2}PW_{12}O_{40}$ and $H_3PW_{12}O_{40}/ZrO_{2-}$.

In one embodiment, the solid acid catalyst is selected from an acidic aluminosilicate zeolite or an acidic silicon aluminium phosphate (SAPO) zeolite.

In another embodiment, the solid acid catalyst is an acidic aluminosilicate zeolite having the general formula (I):

$$[M^{n+}]_{x/n}[(AlO_2^-)_x(SiO_2)_y] \quad (I)$$

wherein

M is $H^+$ or M is two or more different cations, one of which is $H^+$; and the Si/Al ratio y/x is from 1 to 300.

In one embodiment, the Si/Al ratio y/x may for instance be from about 20 to about 90, for instance be from about 30 to about 90, for instance from about 40 to about 80, or for example from about 50 to about 70, or from about 55 to about 65. In one embodiment, the Si/Al ratio y/x is about 60.

When M is two or more different cations, one of which is $H^+$, the charge ratio of $H^+$ to the other cations M is typically equal to or greater than 1. In other words at least half of the positive charges, arising from all the $M^{n+}$ cations are typically due to protons.

In one embodiment, the solid add catalyst is H-ZSM-5.

Typically, the solid acid catalyst is H-ZSM-5 with an Si/Al ratio of from 20 to 90, for instance from 30 to 90, for instance from 40 to 80, or for example from 50 to 70, or from 55 to 65. In one embodiment, the solid acid catalyst is H-ZSM-5 with an Si/Al ratio of about 60. Such H-ZSM-5 catalysts are commercially available from ZEOLYST international Company.

In one embodiment, the catalyst composition comprises a mesopororus solid acid catalyst. The meaning of the term "mesoporous" in the context of catalysis is well known in the art. For instance, the IUPAC Goldbook defines mesoporous as meaning pores of intermediate size between microporous and macroporous, in particular with widths between 2 nm and 0.05 μm.

As used herein the term "sulphur removal catalyst" refers to a catalyst commonly employed in hydrodesulfurization reactions. Sulphur removal catalysts may also be referred to as HDS catalysts. Examples of sulphur removal catalysts are well known to the skilled person. For example, a sulphur removal catalyst is typically based on metals from groups VIB and VII of the Periodic Classification of the Elements. For instance, sulphur removal catalyst typically comprises a transition metal capable of forming bonds to sulphur or oxygen, for example, Ni, Mo, Co, Cu, Zn, W, Fe, W, Pd, Pt, Rh, Ru.

Accordingly, the sulphur removal catalyst may be a sulphur removal catalyst comprising oxides and/or sulphides of transition metals, e.g. Ni, Mo, Co, Cu, Zn, W, Fe, W, Pd, Pt, Rh, Ru as catalytic components. The transition metal catalyst may be supported on materials with high surface areas, e.g. alumina, $TiO_2$, zeolites etc.

In one embodiment the sulphur removal catalyst is a bimetallic sulphur removal catalyst, in particular a bimetallic oxide or sulphide.

In one embodiment the sulphur removal catalyst is a termetallic sulphur removal catalyst, in particular a termetallic oxide or sulphide.

In one embodiment, the sulphur removal catalyst is a bimetallic sulphur removal catalyst supported on alumina, $TiO_2$, or a zeolite.

In one embodiment, the sulphur removal catalyst is a termetallic sulphur removal catalyst supported on alumina, $TiO_2$, or a zeolite.

In another embodiment, the sulphur removal catalyst comprises oxides/sulphides of cobalt and/or molybdenum on a support selected from alumina. $TiO_2$, and a zeolite. Suitably, the sulphur removal catalyst is a sulphide of cobalt or molybdenum on an $Al_2O_3$ support.

Suitable, sulphur removal catalysts may have bimetallic catalytic components as follows: copper and zinc (CuZn), copper and nickel (CuNi), cobalt and molybdenum (CoMo), nickel and molybdenum (NiMo), nickel and tungsten (NiW).

Suitable, sulphur removal catalysts may have catalytic components comprising one or more of oxides of copper, zinc, iron, nickel, cobalt, tungsten and/or molybdenum.

Suitable sulphur removal catalysts may have catalytic components as follows: oxides of copper and zinc (CuZnOx), oxides of copper and nickel (CuNiOx), oxides of cobalt and molybdenum (CoMoOx), oxides of nickel and molybdenum (NiMoOx), oxides of nickel and tungsten (NiWOx), sulphides of copper and zinc (CuZnSx), sulphides of copper and nickel (CuNiSx), sulphides of cobalt and molybdenum (CoMoSx), sulphides of nickel and molybdenum (NiMoOx) and sulphides of nickel and tungsten (NiWSx).

In one embodiment, the sulphur removal catalyst has a catalytic component selected from CoMo/alumina, NiMo/alumina, NiW/zeolite.

In another embodiment, the sulphur removal catalyst has a catalytic component selected from: oxides of nickel and molybdenum (NiMoOx), oxides of nickel and tungsten (NiWOx), and sulphides of cobalt and molybdenum (CoMoSx).

In another embodiment, the sulphur removal catalyst has a catalytic component selected from: oxides of nickel and molybdenum supported on alumina ($NiMoOx/Al_2O_3$), oxides of nickel and tungsten supported on ZSM-5 (NiWOx/ZSM-5), and sulphides of cobalt and molybdenum supported on alumina ($CoMoSx/Al_2O_3$).

In one embodiment, the sulphur removal catalyst is sulphurized. In another embodiment, the sulphur removal catalyst is used without sulphurization.

In one embodiment, the catalyst composition comprises a solid acid catalyst selected from an acidic aluminosilicate zeolite and an acidic silicon aluminium phosphate (SAPO) zeolite, and a sulphur removal catalyst comprising a catalytic component selected from CuZn, CuNi, CoMo, NiMo, NiW, CuZn, CuNi, CoMo, NiMo and NiW optionally on a support.

In one embodiment, the catalyst composition comprises a solid acid catalyst selected from an acidic aluminosilicate zeolite and an acidic silicon aluminium phosphate (SAPO) zeolite, and a sulphur removal catalyst comprising a catalytic component selected from CuZnOx, CuNiOx, CoMoOx, NiMoOx, NiWOx, CuZnSx, CuNiSx, CoMoSx, NiMoOx and NiWSx, optionally on a support.

In another embodiment, the catalyst composition comprises a solid acid catalyst selected from a mesoporous acidic aluminosilicate zeolite and a mesoporous acidic silicon aluminium phosphate (SAPO) zeolite, and a sulphur removal catalyst comprising a catalytic component selected from CuZnOx, CuNiOx, CoMoOx, NiMoOx, NiWOx, CuZnSx, CuNiSx, CoMoSx, NiMoOx and NiWSx, optionally on a support.

In another embodiment, the catalyst composition comprises H-ZSM-5, and a sulphur removal catalyst comprising a catalytic component selected from CuZnOx, CuNiOx, CoMoOx, NiMoOx, NiWOx, CuZnSx, CuNiSx, CoMoSx, NiMoOx and NiWSx, optionally on a support.

In another embodiment, the catalyst composition comprises mesoporous H-ZSM-5, and a sulphur removal catalyst comprising a catalytic component selected from CuZnOx, CuNiOx, CoMoOx, NiMoOx, NiWOx, CuZnSx, CuNiSx, CoMoSx, NiMoOx and NiWSx, optionally on a support.

In one embodiment, the ratio of solid acid catalyst to sulphur removal catalyst in the catalyst composition is from about 10:1 to about 1:10. In another embodiment, the ratio is about 5:1 to about 1:2, for example about 1:1.

In one embodiment, the catalyst composition comprises a solid acid catalyst and a sulphur removal catalyst, wherein the sulphur removal catalyst is not supported on the solid acid catalyst, i.e. chemically bonded to the solid acid, catalyst.

In another embodiment, the catalyst composition may further comprise a dehalogenation catalyst. Suitable dehalogenation catalysts include metal oxides (e.g. ZnO, CaO, $FeO_X$), alkali and earth metal bases (e.g. KOH, $K_2CO_3$, $Ca(OH)_2$, $CaCO_3$), metal hydroxides (e.g. $Fe(OH)_x$) and metal-carbon composites (Fe—C or Ca—C) catalyst.

In another embodiment, the catalyst composition may further comprise ion exchange resin. Suitably the ion-exchange resin is a cation exchange resin, suitably a sulfonic acid-based ion exchange resin.

In one embodiment, the catalyst composition consists of a solid acid catalyst, an ion-exchange resin, a sulphur removal catalyst, and a dehalogenation catalyst, suitably the mass ratio is about 2:2:1.1.

In one the catalyst composition consists of a zeolite, at least one metal oxide, and an ion-exchange resin.

In one the catalyst composition consists of a zeolite, an ion-exchange resin, an iron oxide, a zinc oxide, suitably the mass ratio is about 2:2:1:1.

In one embodiment, the catalyst composition is a mechanical mixture the components. That is to say the catalyst composition is a heterogeneous mixture of the individual catalysts/resins. As such the catalysts and resins do not chemically modified one another, they are simply in physical mixture.

Absorption

In another embodiment, following treatment of the pyrolysis oil with the upgrading solution, the raffinate may be treated with an absorbent.

Accordingly, in one embodiment, the present invention relates to a process for producing an upgraded pyrolysis oil product comprising:

(i) treating a pyrolysis oil with an upgrading solution to provide a mixture comprising an extract phase and a raffinate phase and separating the raffinate phase, wherein the upgrading solution comprises a polar organic solvent;

(ii) treating the separated raffinate phase of step (i) with an absorbent;

wherein the pyrolysis oil is derived from the pyrolysis of plastic or rubber or a combination thereof.

In another aspect, the present invention relates to a process for producing an upgraded pyrolysis oil product comprising:

(i)(a) treating a pyrolysis oil with an upgrading solution, wherein the upgrading solution comprises an polar organic solvent;

(i)(b) optionally treating the product of (i)(a) with a hydrocarbon fluid;

(ii) mixing the mixture obtained from (i)(a), or optionally (i)(b), and then allowing the mixture to form at least two, phases comprising a raffinate phase and an extract phase, and (iii) separating the raffinate phase from the extract phase;

(iv) treating the separated raffinate phase of step (iii) with an absorbent;

wherein the pyrolysis oil is derived from the pyrolysis of plastic or rubber, or a combination thereof.

The raffinate/upgraded pyrolysis oil may be treated with the absorbent by any means known in the art. For instance, the raffinate/upgraded pyrolysis oil and absorbent may be combined and either left to stand, stirred or shaken together, or a combination thereof. Alternatively, the raffinate/upgraded pyrolysis oil may be flowed over a bed of the absorbent.

In one embodiment, the treatment with absorbent is carried out at a temperature of between about 0° C. and about 300° C., more typically between about 15° C. and about 250° C., and a pressure of between about 100 and about 500 KPa, suitably about 100 to about 250 KPa.

Alternatively, the treatment is carried out at a temperature between about 0° C. and about 70° C., suitably about 15° C. to about 50° C.

In one embodiment, the treatment with absorbent is carried out at ambient temperature and pressure. Typically, a temperature of between about 18 and about 28° C., more typically between about 21 and about 25° C., and a pressure of about 100 kPa Suitably, the absorbent is capable of absorbing one or more heteroatoms (suitably sulfur and/or chloride) from the raffinate/upgraded pyrolysis oil. Particular examples of suitable absorbents are zeolites, aluminosilicates, activated carbon and mixtures thereof.

In one embodiment, the absorbent, is a commercially available molecular sieves. Suitably, the absorbent is a microporous molecular sieve (i.e. pore diameter of 2 nm or less).

In one embodiment, the absorbent is a zeolite molecular sieves suitably selected from 3A, 4A, 5A, 10X, 13X. Suitably, the absorbent is zeolite molecular sieves 13X.

In one embodiment, the zeolite is a zeolite of the faujasite series, suitably a zeolite Y (e.g. zeolite Na—Y or La—Y).

In one embodiment the absorbent is selected from a zeolite molecular sieves 3A, 4A, 5A, 10X, 13X, or zeolite Na—Y and La—Y. In another embodiment, the absorbent is selected from zeolite molecular sieves 13X and zeolite Na—Y or La—Y. In another embodiment, the absorbent is selected from zeolite molecular sieves 13X and zeolite Na—Y. The invention will now be further described by way of the following numbered paragraphs:

1. A process for upgrading a pyrolysis oil comprising, treating the pyrolysis oil with an upgrading solution to provide a mixture comprising an extract phase and a raffinate phase, wherein the upgrading solution comprises a polar organic solvent, and wherein the pyrolysis oil is a derived from the pyrolysis of plastic or rubber, or a combination thereof.
2. A process for producing an upgraded pyrolysis oil product comprising:
   (i) treating a pyrolysis oil with an upgrading solution, wherein the upgrading solution comprises an polar organic solvent;
   (ii) mixing the pyrolysis oil and the upgrading solution and then allowing the mixture to form two phases consisting of a raffinate phase and an extract phase, and
   (iii) separating the raffinate phase from the extract phase to yield an upgraded pyrolysis oil product;
   wherein the pyrolysis oil is a derived from the pyrolysis of plastic or rubber, or a combination thereof.
3. A process for producing an upgraded pyrolysis oil product comprising:
   (i)(a) treating a pyrolysis oil with an upgrading solution, wherein the upgrading solution comprises an polar organic solvent;
   (i)(b) optionally treating the product of (i)(a) with a hydrocarbon fluid;
   (ii) mixing the pyrolysis oil and the upgrading solution obtained from (i)(a), or optionally (I)(b), and then allowing the mixture to form at least two phases comprising a raffinate phase and an extract phase, and
   (iii) separating the raffinate phase from the extract phase to yield an upgraded pyrolysis oil product;
   wherein the pyrolysis oil is a derived from the pyrolysis of plastic or rubber, or a combination thereof.
4. A process according to any one of paragraphs 1 to 3 wherein the upgrading solution comprises at least one polar organic solvent with a dipole moment (D) of about 1.5 or more, suitably about 2.0 or more, suitably about 2.5 or more.

5. A process according to any one of the preceding paragraphs wherein the upgrading solution comprises at least one polar organic solvent with a dipole moment (D) of about 3.5 to about 6.0, suitably about 3.5 to about 5.5, suitably about 3.5 to about 5.0.
6. A process according to any one of the preceding paragraphs wherein the polar organic solvent is selected from one or more of an alcohol, a carbonate, an amide, an organosulphur compound, a nitrile and a heterocyclic compound, suitably a carbonate and an organosulphur compound.
7. A process according to any one of the preceding paragraphs wherein the polar organic solvent is selected from methanol, ethanol, ethylene glycol, propylene carbonate, sulfolane, acetic acid, propanoic acid, DMSO, NMP, DMF, DMA and pyridine, suitably NMP, propylene carbonate and sulfolane.
8. A process according to any one of the preceding paragraphs wherein the upgrading solution has a specific gravity (20/4) of about 0.95 or more, suitably 1 or more.
9. A process according, to any one of the preceding paragraphs wherein the upgrading solution further comprises one or more of another solvent, an acid, a base or organometallic compound.
10. A process according to paragraph 9 wherein the further solvent is selected from an alcohol, an aldehyde, a ketone, an ether, a carboxylic acid, an ester, a carbonate, an acid anhydride, an amide, an amine, a heterocyclic compound, an imine, an imide, a nitrile, a nitro compound, a sulfoxide, and a haloalkane.
11. A process according to any one of paragraphs 9 and 10 wherein the further solvent is selected from methanol, ethanol, propanol, isopropanol, ethylene glycol, propylene glycol, and propane-1,3-diol, suitably methanol.
12. A process according to any one of the preceding paragraphs wherein the upgrading solution comprises at least about 50% wt. (suitably at least about 90% wt.) of one or more of NMP, sulfolane and propylene carbonate.
13. A process according to any one of the preceding paragraphs wherein the upgrading solution comprises at least about 50% wt. (suitably at least about 90% wt.) of one or more of sulfolane and propylene carbonate, and further comprises an alcohol selected from methanol, ethanol, and ethane-1,2-diol, and optionally a base or organometallic compound.
14. A process according to any one of paragraphs 9 to 11 wherein the acid is selected from methanoic acid (formic acid), ethanoic acid (acetic acid), propanoic acid, butanoic add and pentanoic acid, suitably ethanoic or propanoic acid.
15. A process according to any one of paragraphs 9 to 14 wherein the base is a metal alkali metal hydroxide or carbonate, suitably potassium hydroxide, sodium hydroxide, sodium carbonate and potassium carbonate.
16. A process according to any one of paragraphs 9 to 13 wherein the organometallic compound is an alkali metal salt, suitably potassium acetate, sodium acetate, sodium formate or potassium formate; more suitably potassium acetate or sodium acetate.
17. A process according to any one of paragraphs 1 to 12 wherein the upgrading solution comprises NMP and water.
18. A process according to any one of paragraphs 1 to 12 wherein the upgrading solution consists of about 90% NMP and about 10% water.
19. A process according to any one of the preceding paragraphs wherein the mass ratio of pyrolysis oil to upgrading solution is about 95:5 to about 10:90, suitably about 95:5 to about 50:50, more suitably about 90:10.
20. A process according to any one of the preceding paragraphs wherein the pyrolysis oil is derived from pyrolysis of thermoplastic, suitably one or more of polyethylene, prolypropylene and polystyrene.
21. A process according to any one of paragraphs 1 to 19 wherein the pyrolysis is derived from pyrolysis of rubber.
22. A process according to any one of the preceding paragraphs wherein the pyrolysis oil has a specific gravity (20/4) of about 1 or less, suitably about 0.7 to about 0.95.
23. A process according to any one of the preceding paragraphs wherein prior to treating the pyrolysis oil with the upgrading solution, the pyrolysis oil is treated with an aqueous solution.
24. A process according to any of the preceding paragraphs comprising:
    (i) treating a pyrolysis oil with an aqueous solution to provide a mixture comprising an organic phase and an aqueous phase and separating the organic phase;
    (ii) treating the separated organic phase of step (i) with an upgrading solution to provide a mixture comprising an extract phase and a raffinate phase;
    (iii) separating the raffinate phase from the extract phase to yield an upgraded pyrolysis oil product;
    wherein the pyrolysis oil is a derived from the pyrolysis of plastic or rubber, or a combination thereof.
25. A process according to any one of the preceding paragraphs wherein mass ratio of pyrolysis oil to aqueous solution is from about 95:5 to about 10:90, or suitably about 60:40 to about 40:60, or suitably about 50:50.
26. A process according to any one of paragraphs 24 to 25 wherein the aqueous solution has a pH of about 5 to about 10, suitably about 6 to 8.
27. A process according to any one of paragraphs 24 to 26 wherein the aqueous solution comprises an acid, a base or an organometallic compound.
28. A process according to paragraph 27 wherein the acid is a carboxylic acid, suitably selected from methanoic acid (formic acid), ethanoic acid (acetic acid), propanoic acid, butanoic acid and pentanoic acid.
29. A process according to paragraph 27 wherein the base is an alkali metal hydroxide or carbonate, suitably potassium hydroxide, sodium hydroxide, sodium carbonate and potassium carbonate.
30. A process according to paragraph 27 wherein the organometallic compound is an alkali metal salt, such as potassium acetate or sodium acetate.
31. A process according to any one of the preceding paragraphs wherein prior to treating the pyrolysis oil with the upgrading solution, the pyrolysis oil is treated with a hydrocarbon fluid.
32. A process according to any one of the preceding paragraphs comprising:
    (i) treating a pyrolysis oil with an aqueous solution and optionally a hydrocarbon fluid to provide a mixture comprising an organic phase and an aqueous phase and separating and optionally filtering the organic phase;

(ii) treating the separated organic phase of step (i) with an upgrading solution to provide a mixture comprising an extract phase and a raffinate phase;

(iii) separating the raffinate phase from the extract phase to yield an upgraded pyrolysis oil product;

wherein the pyrolysis oil is a derived from the pyrolysis of plastic or rubber, or a combination thereof.

33. A process according to any one of paragraphs 31 and 32 wherein the mass ratio of pyrolysis oil to hydrocarbon fluid is from about 95:5 to about 10:90, suitably about 60:40 to about 40:60, or suitably about 50:50.

34. A process according to any one of paragraphs 3 to 33 wherein the hydrocarbon fluid is a $C_3$ to $C_{20}$ alkane, suitably a $C_5$ to $C_{16}$ alkane.

35. A process according to any one of paragraphs 3 to 34 wherein the hydrocarbon fluid is selected from pentane, hexane, heptane, octane, nonane, decane, undecane, dodecane, tridecane, tetradecane, and hexadecane (cetane).

36. A process according to any one of the preceding paragraphs wherein the raffinate phase is treated with an absorbent.

37. A process according to paragraph 36 wherein the absorbent is a zeolite, an aluminosilicates or activated carbon.

38. A process according to any one of paragraphs 36 or 37 wherein the absorbent is selected from zeolite molecular sieves 13X and zeolite Na—Y or La—Y.

39. A process according to any one of paragraphs 1 to 35 wherein the raffinate phase is treated with a blending agent comprising a $C_{1-4}$ alcohol and the resultant feedstock is contacted with a catalyst composition; and wherein the catalyst composition comprises a combination of a solid acid catalyst and a sulphur removal catalyst.

40. A process for producing an upgraded pyrolysis oil product comprising:

(i) treating a pyrolysis oil with an aqueous solution and optionally a hydrocarbon fluid to provide a mixture comprising an organic phase and an aqueous phase and separating and optionally filtering the organic phase;

(ii) treating the separated organic phase of step (i) with an upgrading solution to provide a mixture comprising an extract phase and a raffinate phase and separating the raffinate phase, wherein the upgrading solution comprises a polar organic solvent;

(iii) treating the separated raffinate phase of step (ii) with a blending agent comprising a $C_{1-4}$ alcohol and contacting the resultant feedstock with a catalyst composition to yield an upgraded pyrolysis oil product; wherein the catalyst composition comprises a combination of a solid acid catalyst and a sulphur removal catalyst; and wherein the pyrolysis oil is derived from the pyrolysis of plastic or rubber, or a combination thereof.

41. A process according to any one of paragraphs 39 and 40 wherein the feedstock is contacted with the catalyst composition at a temperature of about 40° C. to 200° C., for example from about 40° C. to 150° C.

42. A process according to any one of paragraphs 39 to 41 wherein the feedstock is contacted with the catalyst composition at a pressure of about 101 KPa to about 350 KPa, suitably about 101 KPa 43. A process according to any one of paragraphs 39 to 42 wherein the feedstock is contacted with the catalyst composition at a weight hour space velocity (WHSV) of from about 0.1 $hr^{-1}$ to about 10 $hr^{-1}$, suitably about 0.1 $hr^{-1}$ to about 2.5 $hr^{-1}$.

44. A process according to any one of paragraphs 39 to 43 wherein the blending agent comprises methanol.

45. A process according to any one of paragraphs 39 to 44 wherein the blending agent comprises at least about 50% wt. % methanol, suitably at least about 90% wt. methanol.

46. A process according to any one of paragraphs 39 to 45 wherein the mass ratio of raffinate to blending agent in the feedstock is about 60:40 to about 10:90, suitably about 60:40 to about 40:60.

47. A process according to any one of paragraphs 39 to 46 wherein the solid acid catalyst is selected from a hydrogen zeolite (an H-zeolite), suitably H-ZSM-5, H-Beta, H—Y or H-Mordenite.

48. A process according to any one of paragraph 39 to 47 wherein the sulphur removal catalyst is selected from oxides, hydroxides and/or sulphides of transition metals such as Ni, Mo, Co, Cu, Zn, W, Fe, W, Pd, Pt, Rh, Ru.

49. A process according to an one of paragraphs 39 to 48 wherein the sulphur removal catalyst is selected from oxides of copper, zinc, iron, nickel, cobalt, tungsten and/or molybdenum.

50. A process according to any one of paragraphs 39 to 49 wherein the catalyst composition further comprises a dehalogenation catalyst, suitably selected from metal oxides (e.g. ZnO, CaO, $FeO_x$), alkali and earth metal bases (e.g. KOH, $K_2CO_3$, $Ca(OH)_2$, $CaCO_3$), metal hydroxides (e.g. $Fe(OH)_x$) and metal-carbon composites (Fe—C or Ca—C) catalyst.

51. A process according to any one of paragraphs 39 to 50 wherein the catalyst composition further comprises an ion-exchange resin, suitably selected from a sulfonic acid-based ion exchange resin.

52. Use of an upgrading solution for decreasing the olefin content of a pyrolysis oil, wherein the upgrading solution comprises a polar organic solvent, and wherein the pyrolysis oil is a derived from the pyrolysis of plastic or rubber, or a combination thereof.

53. Use of an upgrading solution for decreasing the solid residue content of a pyrolysis oil, wherein the upgrading solution comprises a polar organic solvent; and wherein the pyrolysis oil is a derived from the pyrolysis of plastic or rubber, or a combination thereof.

54. Use of an upgrading solution for increasing the stability of a pyrolysis oil, wherein upgrading solution comprises wherein the upgrading solution comprises a polar organic solvent; and wherein the pyrolysis oil is a derived from the pyrolysis of plastic or rubber, or a combination thereof.

55. An upgraded pyrolysis oil obtainable by a process according to any one of paragraphs 1 to 51.

Examples

A. Preparation of the Pyrolysis Oil

Solvents and chemicals were purchased from Sigma Aldrich and fisher Scientific.

Figure 2:
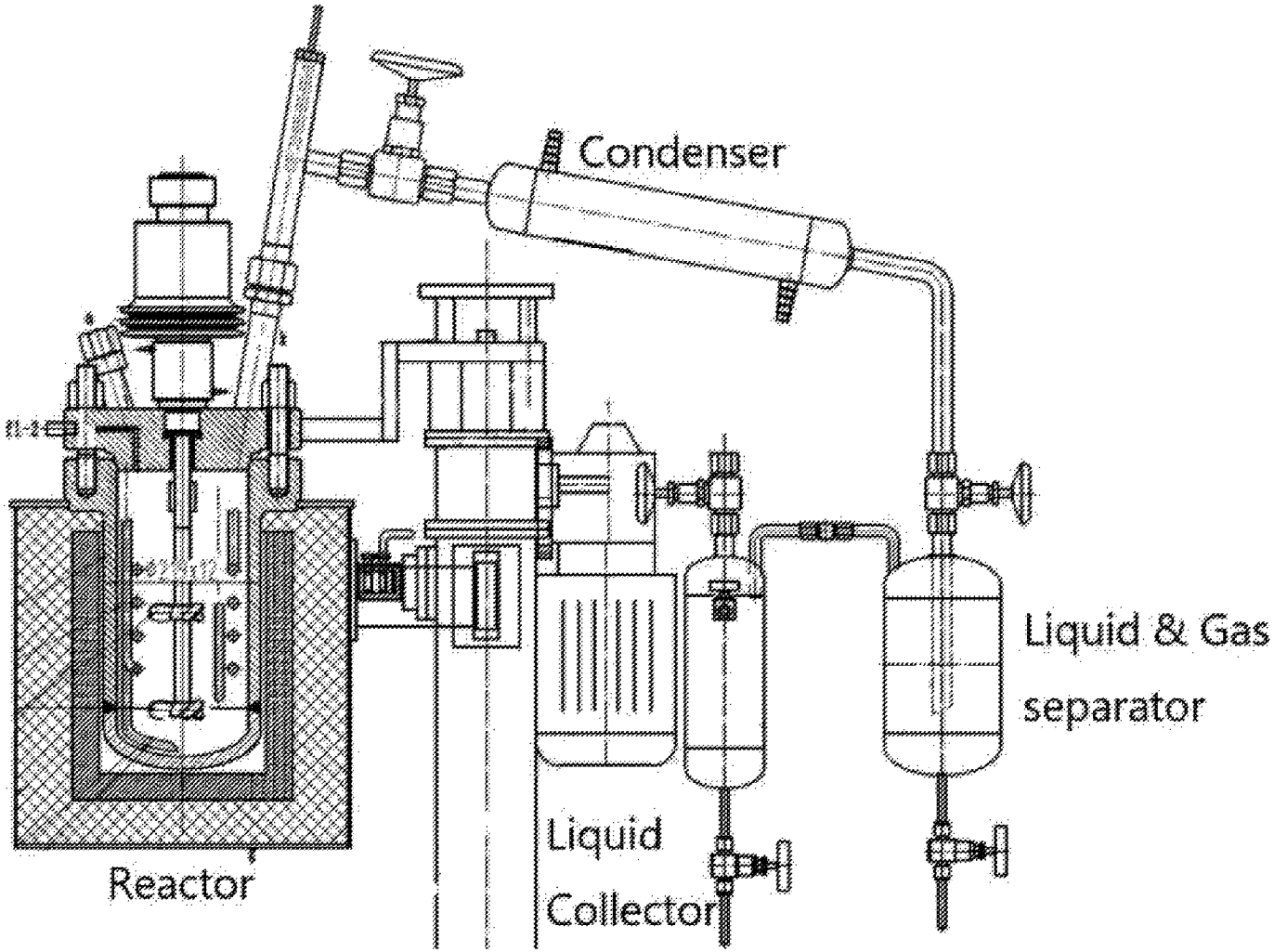
FIG. 2 provides a schematic of a pyrolysis unit

Plastic pyrolysis oils from different plastics (LDPE, PP, PS, rubber, mix) were produced on a lab-scale pyrolysis, unit (FIG. 2), LDPE, PP, PS for producing the pyrolysis oil was used in the form of pellets (Sigma Aldrich). Rubber for producing the pyrolysis oil was used also in pelleted form having been obtained from waste tyres.

Each material (LDPE, PP, PS and rubber) as well a mixture were subject to pyrolysis. The raw material for producing mixed rubber/plastic pyrolysis oil (hereafter "mixed pyrolysis oil") was composed of 25% LDPE, 25% PP, 25% PS and 25% rubber (% in weight). Pyrolysis was conducted batchwise in 10 L batch units. Prior to pyrolysis the pyrolysis unit was purged with nitrogen to generate an inert atmosphere in the unit. Pyrolysis was conducted without catalyst and at various temperatures depending on the raw material, and at atmospheric pressure. LDPE was pyrolyzed at 450° C., PP was pyrolyzed at 450° C., PS was pyrolyzed at 400° C., rubber was pyrolyzed at 500° C. and mixed raw material was pyrolyzed at 450° C. Water (at a temperature of about 15° C.) was used in the condenser to cool down the pyrolysis vapour. Pyrolysis oils were collected after each pyrolysis process, and the non-condensable gas had been vented.

B. Aqueous Wash of the Pyrolysis Oil

B1. Water Wash

Each sample of pyrolysis oil and distilled water (pH 7) were fed into the separation funnel in a mass ratio of 10:1 pyrolysis oil to water. Mixing was performed by shaking the funnel well. After complete phase separation (two liquid phases) was observed in the mixture, the mixture was allowed to stabilize for another 5 minutes. Then, the pyrolysis oil layer and water layer were separated and analysed. The pH level of the water phase after the water wash was been analysed by pH meter (Table 2).

TABLE 2 pH of water wash

| Pyrolysis oil | LDPE | PP | PS | Rubber | Mix |
|---|---|---|---|---|---|
| After water wash water phase pH level | 6.45 | 6.15 | 6.04 | 4.45 | 5.61 |

All of the water phase samples from water wash process presented weak acidity indicating that acidic contents from the pyrolysis oil had been extracted by the water wash process.

Furthermore, asphaltenes/coke and other solid residue is retained in the water phase. The asphaltenes can thus, be easily separated from the organic phase.

B2. Alkane Wash

Iso or n-alkane (paraffin) with 5-16 carbon atoms have been applied as the paraffin feed stream in the test. N-pentane with purity of 99%, n-hexane with purity of 97%, iso-octane with purity of 99.8%, iso-dodecane with purity of 99%, n-dodecane with purity of 99%, n-cetane with purity of 99% were purchased from Sigma Aldrich and applied in the following treatment.

Mixed pyrolysis oil and separately each of the above parrafins were mixed by shaking and rotating in a 1:1 pyrolysis oil to paraffin weight ratio in a glass container. During mixing flocculation was observed in the mixture, black flocculate separates from the liquid mixture. After mixing, each mixture was stabilized for another 5 minutes. Then, the liquid mixture and flocculate were separated by filtration and analysed.

Colour and transparency of each pyrolysis oil before and after the paraffin wash were directly compared with and without light source (sun light). In particular, the same amount of oil samples were prepared and put into 15 ml clear glass tube bottle for consistency.

Figure 3A:
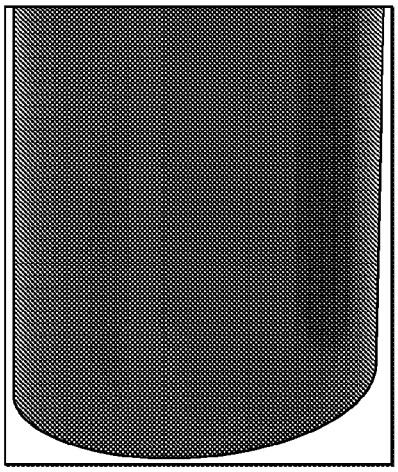
FIG. 3A shows the colour of the mixed pyrolysis oil (made from 25% LDPE, 25% PP, 25% PS and 25% rubber in weight).
Figure 3B:
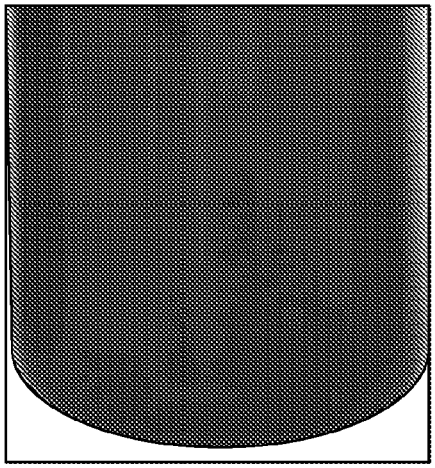
FIG. 3B shows the pyrolysis oil after a paraffin wash and FIG. 3C shows the same under sunlight.
Figure 3C:
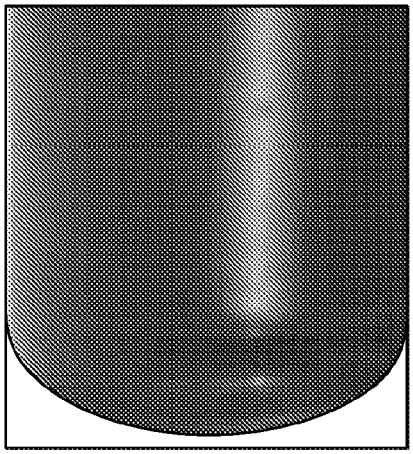

Colour change after the purification process is significant. The original mixed pyrolysis oil (made from 25% LDPE, 25% PP, 25% PS and 25% rubber in weight) is very dark in colour and not transparent even though strong torch light (FIG. 3). After the paraffin wash with n-hexane however the pyrolysis oil became clear under sun light (FIG. 3*c*).

Thermogravimetric Analysis (TGA) and Differential Scanning Calorimetry (DSC) were applied to the output of the water wash followed by paraffin wash. The analyser was a TA Instruments SDT Analyzer Model Q600. The analysis program was: 100 ml/min carrier gas flow rate ($N_2$), 10° C./min heating rate, final temperature is 500° C. hold for 5 minutes, then carrier gas was changed to air and heated to 800° C. to burn off the residues in the sample holder. As can be seen in Table 3, the water wash followed by n-cetane wash was able to be reduce to 0.44% in wt. (76.09% total reduction ratio) the residue above 400° C.

TABLE 3

Residue analysis of different pyrolysis oil samples

| Pyrolysis Oil Sample | Residue above 400° C. (Weight %) |
|---|---|
| Original mixed pyrolysis oil | 1.84 |
| After water/n-pentane wash | 0.59 |
| After water/n-hexane wash | 0.55 |
| After water/iso-octane wash | 0.54 |
| After water/iso-dodecane wash | 0.46 |
| After water/n-dodecane wash | 0.46 |
| After water/n-cetane wash | 0.44 |

The olefin content in the original mixed pyrolysis oil and the output of the paraffin wash was analysed by Gas Chromatography-Mass Spectrometry (GCMS). The GCMS analyser was a Perkin Elmer Clarus 500 GCMS gas chromatography mass spectrometer. The main operating parameters of GCMS analyser were: Column Oven Temperature 35° C./308K; Injection Temperature 205° C./478 K; Injection Mode direct; Temperature rising rate from 35 to 200° C./473 K was 3° C./min.

The results are shown in Table 4. Wash with n-cetane reduced the olefin content in mixed pyrolysis oil from 36.10% to 16.97% in GCMS Area (52.99% total reduction ratio).

TABLE 4

Olefin content in different pyrolysis oil samples

| Oil Sample | Olefin Content (GCMS Area %) |
|---|---|
| Original mixed pyrolysis oil | 36.10 |
| After wash with water/n-pentane | 19.29 |
| After wash with water/n-hexane | 18.09 |
| After wash with water/iso-octane | 17.94 |
| After wash with water/iso-dodecane | 17.84 |
| After wash with water/n-dodecane | 17.77 |
| After wash with water/n-cetane | 16.97 |

The heteroatoms content (i.e. sulphur, nitrogen, chloride, bromide) in the mixed pyrolysis oil and the output of the paraffin wash has also been analysed by GCMS. Table 5 shows the heteroatoms content in the mixed pyrolysis oil before and after an n-cetane wash.

TABLE 5

Heteroatoms content in mixed pyrolysis oil

| Heteroatom content | Sulphur (% in GCMS area) | Nitrogen (% in GCMS area) | Chloride (% in GCMS area) | Bromide (% in GCMS area) |
|---|---|---|---|---|
| Original mixed pyrolysis oil | 0.24 | 6.15 | 0.34 | 0.03 |
| After water/ n-cetane wash | 0.07 | 1.31 | 0 | 0 |

Compared to the original mixed pyrolysis oil the sulphur content was reduced 70.83%, the nitrogen content was reduced 78.70%, the chloride content was reduced 100% and the bromide content was also reduced 100%. In total, the heteroatom content in the pyrolysis oil was reduced by 79.59%.

As the high boiling residue and olefin content in the pyrolysis oil has been significantly reduced, this makes the oil much more stable and leads to less fouling on storage for a long time or when subject to heat treatment e.g. distillation (heat exchanger).

The original mixed pyrolysis oil and an upgraded pyrolysis oil after water/paraffin wash were distilled up to 225° C. to separate the gasoline fraction from the pyrolysis oil. Distillation was performed in a round bottom glass flask and heated by electrical mantle, then the output vapour was cool down and condensed by a cool water (about 15° C.) in a condenser and collected by another round bottom flask located in ice water bath (0° C.). In order to remove any air in the system during the distillation, nitrogen was applied as the carrier gas in the distillation system.

Figure 4A:
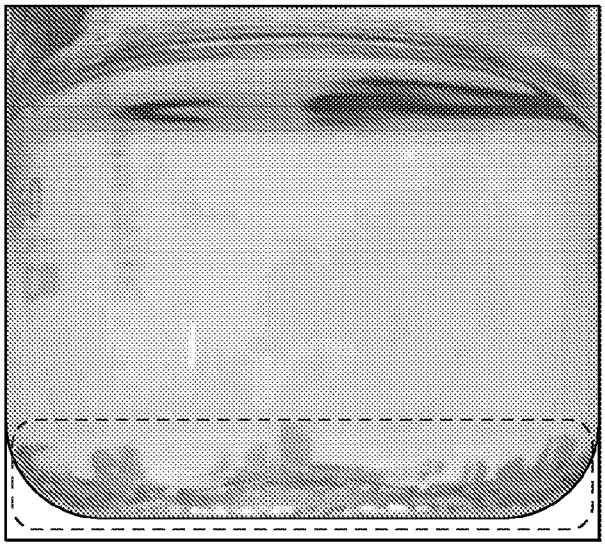
FIG. 4A shows gasoline fractions after distillation of original mixed pyrolysis oil and FIG. 4B shows gasoline fractions after distillation of the upgraded pyrolysis oil.
Figure 4B:
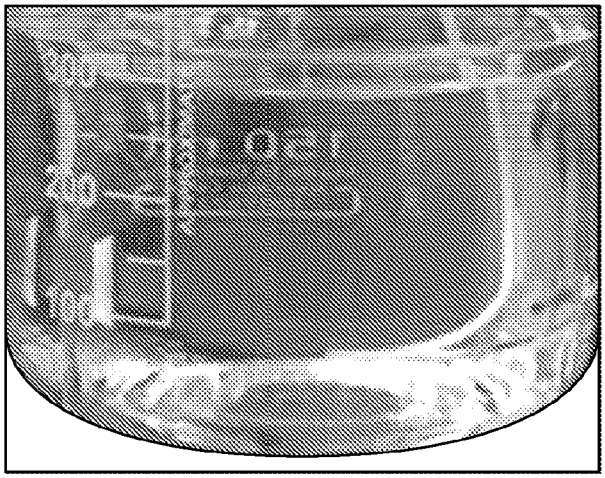

FIG. 4 shows the gasoline fraction yield after distillation of the original and upgraded mixed pyrolysis oil. White flocculate (FIG. 4*a*) can be observed in the gasoline yield of the original mixed pyrolysis oil, but no solid can be observed in the gasoline yield of the upgraded pyrolysis oil (FIG. 4*b*). The white flocculate is due to the heat promoted polymerization of olefins thus leading to the formation of gums. The upgraded pyrolysis oil has much less olefin content, thus it did not have considerable gum formation during the distillation, C. Extraction with Upgrading Solution The original mixed pyrolysis oil was washed with water as set out in B1 above. Subsequently, the organic phase is subjected to an extraction with an upgrading solution.

The process was performed under ambient conditions. Methanol with purity of 99.9%, ethanol with purity of 99.8%, ethylene glycol with purity of 99%, tetraethylene glycol with purity of 99.5%, propylene carbonate with purity of 99.5%, sulfone with purity of 99%, acetic acid with purity of 99.8%, propionic acid with purity of 99.5%, potassium hydroxide with purity of 99.0% and potassium acetate with purity of 99% were employed in the following extractions.

The mixed pyrolysis oil and an upgrading solution, consisting of propylene carbonate 99 wt. % and propionic acid 1 wt. % (upgrading solution 4), were fed into a separation funnel in a mass ratio of 10:1 pyrolysis oil to upgrading solution. Then the mixture was mixed well by shaking the funnel. After complete phase separation (two liquid phases) were observed in the mixture, the mixture was stabilized for another 5 minutes. The raffinate was the upper phase mixture and the extractant, which was the lower phase mixture based on their vertical order. The raffinate and extractant were separated.

Fresh upgrading, solution was added into the raffinate with a mass ratio of 10:1 raffinate to upgrading solution and the extractive purification process was repeated 4 times.

Figure 5A:
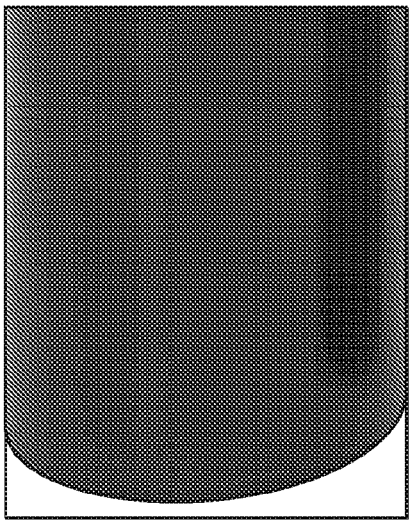
FIG. 5A shows the colour of the original plastic pyrolysis oil.
Figure 5B:
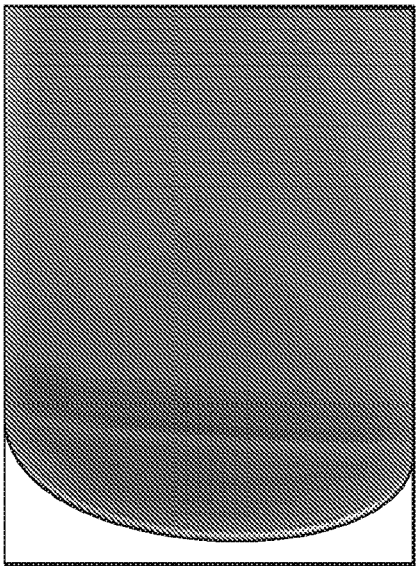
FIG. 5B shows the colour of the pyrolysis oil after purification process.

Colour and transparency of the pyrolysis oil before and after the extraction with the upgrading solution was compared. Using the same volume of pyrolysis oil, samples of the original mixed pyrolysis oil and the raffinate were put into 15 ml clear glass tubes. Colour change after the upgrading solution treatment is significant. The original plastic pyrolysis oil is very dark in colour and not transparent even though strong torch light (FIG. 5*a*). After the purification with the upgrading solution the pyrolysis oil became clear and bright (FIG. 5*b*).

Thermogravimetric Analysis (TGA) and Differential Scanning Calorimetry (DSC) were applied to the raffinate. The analyser was a TA Instruments SDT Analyzer Model Q600. The analysis program was: 100 ml/min carrier gas flow rate ($N_2$), 10° C./min heating rate, final temperature is 500° C. hold for 5 minutes, then carrier gas was changed to air and heated to 800° C. to burn off the residues in the sample holder. As can be seen in Table 5b, the extraction with upgrading solution was able to be reduce residue (above 400° C.) to as low as 0.14% in wt. (92.39% total reduction ratio).

TABLE 5b

Residue analysis of different pyrolysis oil samples

| Pyrolysis Oil Sample | Residue above 400° C. (Weight %) |
|---|---|
| Original plastic pyrolysis oil | 1.84 |
| After extraction with Upgrading Solution 1: Sulfone 91 wt. %, Methanol 8 wt. %, Potassium Hydroxide 1% wt. % | 0.15 |
| After extraction with Upgrading Solution 1: Sulfone 91% wt. %, Ethylene Glycol wt. %, Potassium Hydroxide 1% wt. %. | 0.29 |
| After extraction with Upgrading Solution 3: Propylene Carbonate 99 wt. %, Acetic Acid 1 wt. %. | 0.28 |
| After extraction with Upgrading Solution 4: Propylene Carbonate 99 wt. %, Propionic Acid 1 wt. %. | 0.14 |
| After extraction with Upgrading Solution 5: Propylene Carbonate 90 wt. %, Ethylene Glycol 9 wt. %, Potassium Acetate 1 wt. % | 0.26 |

The olefin content in the original mixed pyrolysis oil and the output of the extraction with upgrading solution was analysed by Gas Chromatography-Mass Spectrometry (GCMS). The GCMS analyser was a Perkin Elmer Clarus 500 GCMS gas chromatography mass spectrometer. The main operating parameters of GCMS analyser were: Column Oven Temperature 35° C./308K; Injection Temperature 205° C./478 K; Injection Mode direct; Temperature rising rate from 35 to 200° C./473 K was 3° C./min.

The results are shown in Table 6. Upgrading solution 4 reduced the olefin content in plastic pyrolysis oil to 11.85% in GCMS Area (67.17% total reduction ratio).

TABLE 6

Olefin content in different pyrolysis oil samples

| Pyrolysis Oil Sample | Olefin Content (GCMS Area %) |
|---|---|
| Original mixed pyrolysis oil | 36.10 |
| After extraction with Upgrading Solution 1: | 13.21 |

TABLE 6-continued

| Olefin content in different pyrolysis oil samples | |
|---|---|
| Pyrolysis Oil Sample | Olefin Content (GCMS Area %) |
| Sulfone 91 wt. %, Methanol 8 wt. %, Potassium Hydroxide 1% wt. % | |
| After extraction with Upgrading Solution 1: Sulfone 91% wt. %, Ethylene Glycol wt. %, Potassium Hydroxide 1% wt. %. | 12.37 |
| After extraction with Upgrading Solution 3: Propylene Carbonate 99 wt. %, Acetic Acid 1 wt. %. | 12.97 |
| After extraction with Upgrading Solution 4: Propylene Carbonate 99 wt. %, Propionic Acid 1 wt. %. | 11.85 |
| After extraction with Upgrading Solution 5: Propylene Carbonate 90 wt. %, Ethylene Glycol 9 wt. %, Potassium Acetate 1 wt. % | 13.15 |

The heteroatoms content (i.e. sulphur, nitrogen, chloride, bromide) in the mixed pyrolysis oil and the output of the extraction with upgrading solution has also been analysed by GCMS. Table 7 shows the heteroatoms content in the mixed pyrolysis oil before and after an extractant with Upgrading solution 4.

TABLE 7

| Heteroatoms content in mixed pyrolysis oil | | | | |
|---|---|---|---|---|
| Heteroatoms content | Sulphur (% in GCMS area) | Nitrogen (% in GCMS area) | Chloride (% in GCMS area) | Bromide (% in GCMS area) |
| Original mixed pyrolysis oil | 0.24 | 6.15 | 0.34 | 0.03 |

TABLE 7-continued

| Heteroatoms content in mixed pyrolysis oil | | | | |
|---|---|---|---|---|
| Heteroatoms content | Sulphur (% in GCMS area) | Nitrogen (% in GCMS area) | Chloride (% in GCMS area) | Bromide (% in GCMS area) |
| After purification Upgrading Solution 4 | 0.10 | 0.51 | 0.02 | 0.00 |

Compared to the original mixed pyrolysis oil, sulphur content was reduced 58.33%, nitrogen content was reduced 91.71%, chloride content was reduced 94.12% and bromide content was reduced 100%. After the purification process the heteroatoms content in the upgraded pyrolysis oil was reduced 90.68% in total.

D. Catalytic Upgrading of Pyrolysis Oil

Ethers, especially tertiary ethers, MTBE (methyl tert-butyl ether, 2-methoxy-2-methyl propane), TAME (tert-amyl methyl ether 2-methoxy-2-methyl butane) and ETBE (ethyl tert-butyl ether, 2-ethoxy-2-methyl propane) have become important components for reformulated gasoline due to tightening legislation concerning fuels.

The ethers improve the combustion of the fuels and thus reduce the exhaust hydrocarbon and carbon monoxide emissions significantly. In addition, they improve the cold weather drivability and have high blending octane numbers.[22]

During the catalytic upgrading process the blended alcohol reacts with the olefin contents (e.g. di-olefins, alpha olefins etc.) to form ethers/stabilized olefin isomers (e.g. 2-olefins etc.). The scheme below shows an example of methanol reacting with olefin content during the catalytic upgrading process.

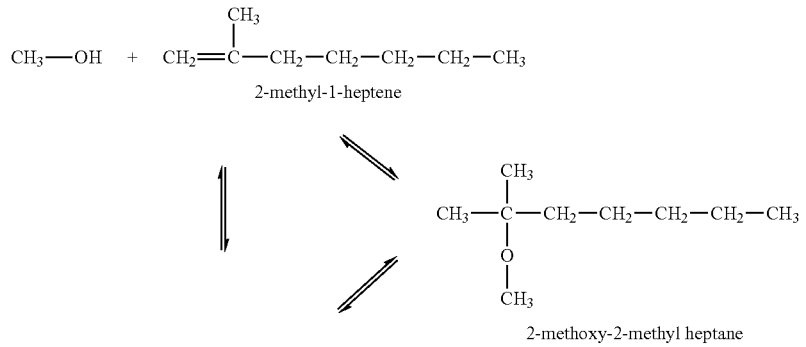

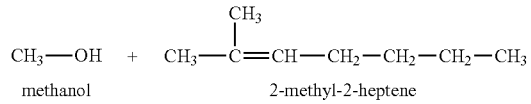

A mixture of methanol and a pyrolysis oil (40 g) was utilised as the feedstock for the catalytic upgrading process. The methanol was blended with the pyrolysis oil in a weight ratio of 1:9.

Figure 6:
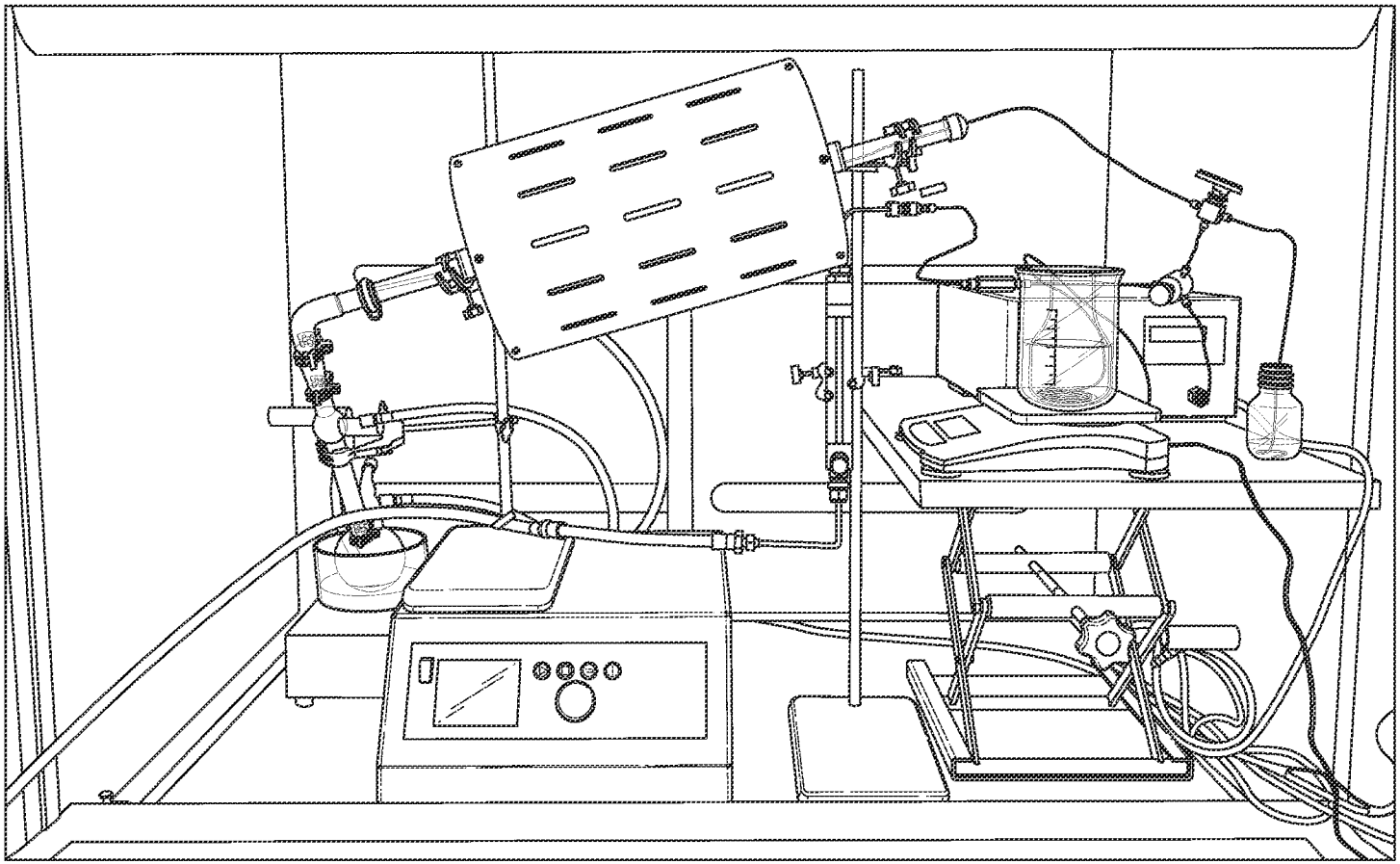
FIG. 6 shows the equipment used for the catalytic upgrading process

Feedstock was fed into the glass tube reactor (FIG. 6) by a HPLC pump. The pumping flow rate of the mixture into the reactor was 40 g/hour, and the LHSV of the reaction is between 0.5-4 $h^{-1}$. The catalyst was a multi-function catalyst composition which consisted of a solid acid catalyst, a heat, sensitive macro-porous suifonic ion exchange acid resin catalyst a desulfurization catalyst/sulphur absorbent, a dehalogenation catalyst.

Specifically, the multi-function catalyst composition used in the following study was made of Hβ zeolite with 360:1 Si:Al ratio (purchased from Fisher Scientific), Amberlyst 35 wet catalyst (purchased from Sigma Aldrich), zinc oxide and iron (III) oxide powder with 99.0% purity (purchased from Sigma Aldrich), and it was prepared by mixing. The mixing ratio of Hβ zeolite:Amberlyst 15:zinc oxide iron oxide, in the catalyst composition is 2:2:1:1. The reaction temperature was between 60-120° C., and reaction was conducted under atmosphere pressure.

The product of the reaction was cooled down by a water condenser and collected in a round-bottom flask which was put in an ice bath, and the yield was weighed after the reaction completed. In order to evaluate the performance of the upgrading process, GCMS method was employed to quantify the level of various compounds in the oil produced after the upgrading process.

During the experiment, 40 grams of feedstock (methanol+ pyrolysis oil) was input and the yield of the reaction was 39 grams (97.50% in wt. yield). According to the literature, the etherification and isomerization reaction is very selective and the conversion rate of methanol is very high. On average the selectivity for the etherification and isomerization should be over 98%. The side reactions are the etherification of methanol to dimethyl ether, the formation of alcohol from alkene and water that originates from impurities of reactants and the catalyst (wet) and also from the formation of dimethyl ether, and the dimerization of alkenes.[22] Since the formed dimethyl ether has a relative low boiling point −24° C., dimethyl ether was vaporised even as the product was cooling in the ice bath (0° C.). This is the reason of the yield rate of etherification is 97.50% in wt. not 100% in wt.

The olefin and ether content in different pyrolysis oils and the output of the catalytic upgrading process have been analysed by Gas Chromatography-Mass Spectrometry (GCMS) (Table 8). The GCMS analyser was a Perkin Elmer Clarus 500 GCMS gas chromatography mass spectrometer. The main operating parameters of GCMS analyser were: Column Oven Temperature 35° C./308 K; Injection Temperature 205° C./478 K; Injection Mode direct; Temperature rising rate from 35 to 200° C./473 K was 3° C./min.

TABLE 8

Olefin and ether content in different oil samples

| | Original pyrolysis oil | | Catalytic upgraded pyrolysis oil | | |
|---|---|---|---|---|---|
| Oil Sample | Olefin (GCMS area %) | Oxygenate (GCMS area %) | Olefin (GCMS area %) | Oxygenate (GCMS area %) | Ether (GCMS area %) |
| PP | 47.15 | 12.07 | 42.38 | 17.21 | 5.14 |
| LDPE | 17.80 | 6.78 | 13.77 | 10.71 | 3.93 |
| PS | 41.50 | 1.95 | 25.56 | 14.73 | 12.78 |

TABLE 8-continued

Olefin and ether content in different oil samples

| | Original pyrolysis oil | | Catalytic upgraded pyrolysis oil | | |
|---|---|---|---|---|---|
| Oil Sample | Olefin (GCMS area %) | Oxygenate (GCMS area %) | Olefin (GCMS area %) | Oxygenate (GCMS area %) | Ether (GCMS area %) |
| Rubber | 41.19 | 9.83 | 29.53 | 16.53 | 6.70 |
| Mixed Pyrolysis Oil | 28.26 | 7.38 | 20.56 | 10.79 | 3.41 |

The results are shown in Table 8. The catalytic upgrading process reduces the olefin content in polypropylene (PP) pyrolysis oil to 42.38% (in GCMS area) (10.12% total reduction ratio), meanwhile, 5.14% (in GCMS area) ether has been produced through the process. The olefin content in low density polyethylene (LDPE) pyrolysis oil has been reduced 22.64% (in GCMS area), 3.93% (in GCMS area) ether has been produced after catalytic upgrading process. The olefin content in polystyrene (PS) pyrolysis oil has been reduced 38.41% (in GCMS area), 12.78% (in GCMS area) ether has been produced after the process. The olefin content in waste tyre (rubber) pyrolysis oil has been reduced 28.31% (in GCMS area), through the process 6.70% (in GCMS area) ether has been produced. The olefin content in mixed pyrolysis oil has been reduced 27.25% (in GCMS area), 3.41% (in GCMS area) ether has been produced thought the conversion.

The total GCMS area % of the most unstable component of the pyrolysis oils: multiple double bond olefins (e.g. diolefins, triolefins etc.), was quantified by GCMS before and after the catalytic upgrading process. Results shown in Table 9. It can be seen that between about 41 and 83% of the multiple double bond olefins have been removed from various pyrolysis oils during the catalytic upgrading process.

TABLE 9

Multiple olefin content in different oil samples

| Oil Sample | Multiple Olefin Content (GCMS area %) Original pyrolysis oil | Multiple Olefin Content (GCMS area %) Catalytic upgraded pyrolysis oil | Multiple Olefin Content Reduction Ratio % |
|---|---|---|---|
| PP | 4.82 | 2.18 | 54.77 |
| LDPE | 3.66 | 1.92 | 47.54 |
| PS | 0.25 | 0.1 | 60.00 |
| Rubber | 10.62 | 6.18 | 41.81 |
| Mixed | 2.54 | 0.43 | 83.07 |

Compared to other kind of olefins, alpha-olefins have the lowest octane number and more easily form polymers/gums during storage or heating processes. Thus, the total GCMS area % in two major kind of pyrolysis oil were analysed before and after the catalytic upgrading process to determine the effect on alpha-olefin content.

The results are shown in Table 10. In both samples tested total alpha-olefin had been significantly reduced. Mixed pyrolysis oil had 76.85% total alpha-olefin reduction, rubber pyrolysis oil had 35.19% total alpha-olefin reduction. The upgraded rubber pyrolysis oil had relatively higher increase in beta and other olefin isomer content from the original oil compared to the mixed pyrolysis oil. This can be explained due to differences in the methanol levels in the feedstock.

TABLE 10

| Olefin content in different oil samples | | | | | | |
|---|---|---|---|---|---|---|
| | Original pyrolysis oil | | | Catalytic upgraded pyrolysis oil | | |
| Oil Sample | Alpha Olefin Content (GCMS area %) | Beta Olefin Content (GCMS area %) | Other Olefin Content (GCMS area %) | Alpha Olefin Content (GCMS area %) | Beta Olefin Content (GCMS area %) | Other Olefin Content (GCMS area %) |
| Mixed Plastic | 20.04 | 3.37 | 4.85 | 4.64 | 5.09 | 10.83 |
| Rubber | 30.01 | 4.36 | 6.82 | 19.45 | 3.48 | 6.60 |

These results indicate that the catalytic upgrading process can efficiently reduce the unstable alpha-olefin content and convert it to much more stable, high value, high octane ethers and other olefin isomers under relatively mild conditions (about 60-120° C. and atmospheric pressure).

Solid Residue in the Output of Catalytic Upgrading Process

Thermogravimetric Analysis (TGA) and Differential Scanning Calorimetry (DSC) were applied to the upgraded pyrolysis oils. The analyser is a TA Instruments SDT Analyzer Model Q600. The analysis program was: 100 ml/min carrier gas flow rate (N2), 10° C./min heating rate, final temperature is 500° C. hold for 5 minutes, then carrier gas change to air and heat to 800° C. to burn off the residues in the sample holder.

Table 11 shows the residue (above 400° C.) of the original mixed pyrolysis oil and rubber pyrolysis oil compared to the output of the catalytic upgrading process. The catalytic upgrading process significantly reduced the residue above 400° C. in the rubber pyrolysis oil to 0.33% in wt. (95.90% total reduction ratio), and in the mixed pyrolysis oil the residue was reduced 78.80% (Table 11).

TABLE 11

| Residue analysis of different oil samples | | |
|---|---|---|
| | 400° C. Above Residue (% in wt.) | |
| Oil Sample | Original pyrolysis oil | After catalytic upgrading process |
| Rubber/Tyre Pyrolysis Oil | 8.04 | 0.33 |
| Mixed Plastic Pyrolysis Oil | 1.84 | 0.39 |

The heteroatoms content (i.e. sulphur, nitrogen, chloride, bromide) in the mixed pyrolysis oil and the rubber pyrolysis oil, and the output of catalytic upgrading were analysed by GCMS. Table 12 shows the heteroatoms content in the mixed pyrolysis oil and the rubber pyrolysis oil before and after the catalytic upgrading process.

TABLE 12

| Heteroatoms content in oil samples before and after catalytic upgrading process | | | | |
|---|---|---|---|---|
| | Original pyrolysis oil | | Catalytic upgraded pyrolysis oil | |
| Heteroatoms content | Sulphur (% in GCMS area) | Other Heteroatoms content (% in GCMS area) | Sulphur (% in GCMS area) | Other Heteroatoms content (% in GCMS area) |
| Mixed Pyrolysis Oil | 1.4 | 0.37 | 0.5 | 0.13 |
| Rubber Pyrolysis Oil | 0.85 | 2.15 | 0.47 | 0.55 |

Compared to the original mixed pyrolysis oil, the sulphur content was reduced 64.29%, and the other heteroatoms content was reduced 64.86%. Sulphur content in rubber pyrolysis oil was reduced 44.71% and the other heteroatoms content was reduced 74.42%. After the catalytic upgrading process the total heteroatoms content in the pyrolysis oil was reduced 64.41% for mixed and 66% for rubber pyrolysis oil.

Octane number of the product is another important factor that affects the economy of the whole upgrading process. Gasoline product with higher octane number provides a higher value product and increases the economy of the process. The octane number of the original mixed pyrolysis oil and the yield from the catalytic upgrading process were analysed and the results are shown in Table 13. Compared to the original mixed pyrolysis oil the calculated octane number of the yield from the catalytic upgrading process has a 10.03% (RON), or 20.73% (MON) improvement.

TABLE 13

| Octane number analysis results | | |
|---|---|---|
| Mixture | Mixed plastic pyrolysis oil | Catalytic upgraded pyrolysis oil |
| Calculated Octane Number (RON) | 90.66 | 99.75 |
| Calculated Octane Number (MON) | 82.01 | 99.01 |

Demonstrated above are various upgrading steps for improving the quality of pyrolysis oils derived from plastic and/or rubber. Using mild conditions and sustainable materials, excellent olefin reduction (stabilization), heteroatoms content reduction and solid residue removal can be achieved. Each of the various washing, extraction and catalytic upgrading processes may be used individually or in combination in order to provide high standard, high value, stable fuel products/chemical feedstocks with a low carbon footprint and low cost.

E. Upgrading of Commercially Available Waste Plastic Pyrolysis Oil

Waste plastic pyrolysis oil was obtained from a commercial Rotary Kiln batch pyrolysis plant in Thailand. The waste plastic used as the pyrolysis feedstock is from municipal waste and consists mainly of low grade low density polyethylene (LDPE) films, it also contains small amount of waste tyre/rubber and other plastics e.g. polyvinyl chloride (PVC). The pyrolysis was operated at about 450° C. and under atmosphere pressure.

X-ray fluorescence (XRF) analysis was conducted using A XOS Petra Max, Multi-element HD XRF Analyser to analyse the concentration of 14 different elements in the pyrolysis oil (see Table 14). The analysis method applied was ASTM D4294, ISO 8754 & IP 336 and the scan time 300 seconds.

TABLE 14

Elemental analysis of commercial crude pyrolysis oil

| Element | Concentration (ppm) | Counts |
|---|---|---|
| Ca 20 | ND | 0.0 |
| Cl 17 | 228.2 | 20.8 |
| Co 27 | ND | 0.0 |
| Cr 24 | ND | 0.0 |
| Cu 29 | ND | 1.8 |
| Fe 26 | 6.10 | 65.0 |
| K 19 | ND | 0.4 |
| Mn 25 | ND | 0.4 |
| Ni 28 | 0.13 | 2.5 |
| P 15 | ND | 0.0 |
| S 16 | 602.3 | 21.1 |
| Ti 22 | ND | 0.6 |
| V 23 | ND | 0.0 |
| Zn 30 | ND | 0.0 |

Furthermore, GCMS analysis of the pyrolysis oil was performed to determine, inter alia, the proportion of aromatic and olefin groups in the oil (Table 15). The GCMS analyser was a Perkin Elmer Clarus 500 GCMS gas chromatography mass spectrometer. The main operating parameters of GCMS analyser were: Column Oven Temperature 35° C./308K; Injection Temperature 205° C./478 K; Injection Mode direct; Temperature rising rate from 35 to 200° C./473 K was 3° C./min

TABLE 15

GCMS analysis of commercial crude pyrolysis oil

| Group Compounds | GCMS Area % |
|---|---|
| Paraffin | 51.70 |
| Olefin | 31.08 |
| Naphthalene | 0.08 |
| Aromatics | 6.43 |
| Di-olefin | 0.39 |
| Oxygenates | 9.00 |
| Other | 1.32 |

Upgrading solution 6 which was made up of 90 wt. % NMP (N-Methyl-2-pyrrolidone) and 10 wt. % water was used in an extraction of the above pyrolysis oil.

Upgrading solution 6 and the pyrolysis oil were fed into a separation funnel in a mass ratio of 2:1 pyrolysis oil to upgrading solution. Then the mixture was mixed well by shaking the funnel. After complete phase separation (two liquid phases) were observed in the mixture, the mixture was stabilized for another 5 minutes. The raffinate was the upper phase mixture and the extractant which was the lower phase mixture based on their vertical order. The raffinate and extractant were separated. Fresh upgrading solution was added into the raffinate with a mass ratio of 10:1 raffinate to upgrading solution and the extractive purification process was repeated 4 times.

The raffinate was analysed by XRF using the same technique as previous. Details of the elemental analysis is provided in Table 16.

TABLE 16

Elemental analysis after extraction with upgrading solution 6

| Element | Concentration (ppm) | Counts |
|---|---|---|
| Ca 20 | ND | 0.0 |
| Cl 17 | 101.2 | 9.3 |
| Co 27 | ND | 1.0 |
| Cr 24 | ND | 0.0 |
| Cu 29 | ND | 2.3 |
| Fe 26 | 2.26 | 24.4 |
| K 19 | ND | 0.6 |
| Mn 25 | ND | 0.0 |
| Ni 28 | ND | 1.5 |
| P 15 | ND | 0.0 |
| S 16 | 213.2 | 7.7 |
| Ti 22 | ND | 0.4 |
| V 23 | ND | 0.3 |
| Zn 30 | ND | 0.0 |

In the upgraded pyrolysis oil (raffinate) the chloride level has been reduced from 228.2 ppm to 101.2 ppm (56% reduction). Sulphur level has been reduced from 602.3 ppm to 213.2 ppm (65% reduction). This demonstrates that upgrading solution 6 (90 wt. % NMP+10 wt. % water) can considerably reduce the heteroatoms and sulphur level in the commercial plastic pyrolysis oil.

The raffinate was further analysed by GCMS using the same method as described above (Table 17).

TABLE 17

GCMS analysis after extraction with Upgrading Solution 6

| Group Compounds | GCMS Area % |
|---|---|
| Paraffin | 58.32 |
| Olefin | 30.81 |
| Naphthalene | 0.03 |
| Aromatics | 4.53 |
| Di-olefin | 0.02 |
| Oxygenates | 5.80 |
| Others | 0.48 |

Higher levels of di-olefin leads to reduced stability (e.g. oxidization stability) of the oil and with higher di-olefin levels the oil forms gum more readily meaning a lower oil quality. In the upgraded oil the di-olefin has been reduced from 0.39 GCMS Area % to 0.02 GCMS Area % (95% reduction). Naphthalene has been reduced from 0.08 GCMS Area % to 0.03 GCMS Area % (63% reduction). Oxygenates has been reduced from 9.00 GCMS Area % to 5.80 GCMS Area % (36% reduction).

The raffinate is further treated with an absorbent. In particular, the absorption process was performed by a fixed bed reactor, which has been preloaded with 10 grams of absorbent. The WHSV during the absorption process was 1 $h^{-1}$. The process was operated at room temp (20° C.) and under atmosphere pressure.

The resultant upgraded oil was analyse using XRF as previous. Tables 18 and 19 show the results of using molecular sieves 5A and molecular sieves 13X respectively as the absorbent.

TABLE 18

Elemental analysis of the upgraded pyrolysis oil after absorption with Molecular Sieve 5A

| Element | Concentration (ppm) | Counts |
|---|---|---|
| Ca 20 | ND | 0.0 |
| Cl 17 | 17.36 | 1.6 |
| Co 27 | ND | 0.0 |
| Cr 24 | ND | 0.0 |
| Cu 29 | 0.19 | 4.8 |
| Fe 26 | 1.75 | 19.1 |
| K 19 | ND | 0.0 |
| Mn 25 | ND | 0.6 |
| Ni 28 | ND | 1.9 |
| P 15 | ND | 0.0 |
| S 16 | 130.0 | 4.9 |
| Ti 22 | ND | 0.4 |
| V 23 | ND | 0.5 |
| Zn 30 | ND | 0.0 |

After the absorption step with molecular sieves 5A the chloride level in the upgraded oil has been reduced from 101.2 ppm to 17.36 ppm (83% reduction). The sulphur level has been reduced from 213.2 ppm to 130.0 ppm (39% reduction).

TABLE 19

Elemental analysis of the upgraded pyrolysis oil after absorption with Molecular Sieve 13X

| Element | Concentration (ppm) | Counts |
|---|---|---|
| Ca 20 | ND | 0.0 |
| Cl 17 | ND | 0.0 |
| Co 27 | ND | 0.0 |
| Cr 24 | ND | 0.0 |
| Cu 29 | ND | 2.7 |
| Fe 26 | ND | 0.0 |
| K 19 | ND | 0.0 |
| Mn 25 | ND | 0.8 |
| Ni 28 | ND | 1.1 |
| P 15 | ND | 0.0 |
| S 16 | ND | 0.5 |
| Ti 22 | ND | 0.0 |
| V 23 | ND | 0.3 |
| Zn 30 | ND | 0.0 |

After the absorption step with molecular sieves 13X the chloride level in the upgraded oil has been reduced from 101.2 ppm to none detectable 0 ppm (100% reduction) and the sulphur level has been reduced from 213.2 ppm to none detectable (100% reduction).

The invention claimed is:

1. A process for upgrading a pyrolysis oil comprising treating the pyrolysis oil with an upgrading solution to provide a mixture comprising an extract phase and a raffinate phase, wherein the pyrolysis oil is derived from the pyrolysis of plastic or rubber, or a combination thereof; and wherein the upgrading solution comprises methanol and an alkali metal hydroxide base.

2. A process for producing an upgraded pyrolysis oil product comprising:

(i) treating a pyrolysis oil with an upgrading solution, wherein the upgrading solution comprises methanol and an alkali metal hydroxide base;

(ii) mixing the pyrolysis oil and the upgrading solution and then allowing the mixture to form two phases consisting of a raffinate phase and an extract phase, and (iii) separating the raffinate phase from the extract phase to yield an upgraded pyrolysis oil product;

wherein the pyrolysis oil is derived from the pyrolysis of plastic or rubber, or a combination thereof.

3. The process of claim 2, wherein the base is present in the upgrading solution in an amount of from about 0.5 wt. % to about 5 wt. %.

4. The process of claim 2, wherein the alkali metal hydroxide base is potassium hydroxide.

5. The process of claim 1, wherein the ratio of pyrolysis oil to upgrading solution is about 95:5 to about 10:90.

6. The process of claim 1, wherein prior to treating the pyrolysis oil with the upgrading solution, the pyrolysis oil is treated with an aqueous solution.

7. The process of claim 6, wherein the aqueous solution comprises a base.

8. The process of claim 7, wherein the base is an alkali metal hydroxide.

9. The process of claim 8, wherein the base is present in an amount of from about 0.5 wt. % to about 20 wt. %.

10. The process according to claim 1, comprising the further step of treating the raffinate phase with an adsorbent.

11. The process according to claim 10 wherein the adsorbent is zeolite molecular sieves 13X or zeolite Na—Y.

12. The process of claim 1, wherein the base is present in the upgrading solution in an amount of from about 0.5 wt. % to about 5 wt. %.

13. The process of claim 1, wherein the process comprises reducing the heteroatom content of the pyrolysis oil.

14. The process of claim 1, wherein the alkali metal hydroxide base is potassium hydroxide.

* * * * *